US009135828B2

(12) United States Patent
Leones et al.

(10) Patent No.: US 9,135,828 B2
(45) **Date of Patent: *Sep. 15, 2015**

(54) PROVIDING A DESCRIPTION OF AIRCRAFT INTENT

(71) Applicant: THE BOEING COMPANY, Chicago, IL (US)

(72) Inventors: Javier Lopez Leones, Madrid (ES); Enrique Juan Casado Magana, Madrid (ES); Juan Besada, Madrid (ES); Guillermo Frontera, Madrid (ES)

(73) Assignee: THE BOEING COMPANY, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/266,334

(22) Filed: Apr. 30, 2014

(65) Prior Publication Data

US 2014/0336932 A1 Nov. 13, 2014

(30) Foreign Application Priority Data

May 9, 2013 (EP) ..... 13382171

(51) Int. Cl.
*G08G 5/00* (2006.01)

(52) U.S. Cl.
CPC ..... *G08G 5/0034* (2013.01); *G08G 5/003* (2013.01)

(58) Field of Classification Search
CPC ... G08G 5/003; G08G 5/0034; G01C 21/3697
USPC ..... 701/528
See application file for complete search history.

(56) References Cited

U.S. PATENT DOCUMENTS

2010/0305781 A1* 12/2010 Felix ..... 701/3

FOREIGN PATENT DOCUMENTS

| | | | |
|---|---|---|---|
| EP | 2040137 | A1 | 3/2009 |
| EP | 2482269 | A1 | 8/2012 |
| WO | 2012044405 | A1 | 4/2012 |

OTHER PUBLICATIONS

European Examination Report, Application No. 13 382 171.0—1810, Jun. 11, 2015.

(Continued)

*Primary Examiner* — Mary Cheung
*Assistant Examiner* — Yuen Wong
(74) *Attorney, Agent, or Firm* — Vista IP Law Group LLP; Cynthia A. Dixon

(57) ABSTRACT

The present invention provides a computer-implemented method of generating an aircraft intent description expressed in a formal language that provides an unambiguous four-dimensional description of an aircraft's intended motion and configuration during a period of flight. A flight intent description is parsed to provide instances of flight intent that span a flight segment, the flight segments together spanning the period of flight. The parsed flight intent is enriched with objectives and constraints according to user preferences, operational context and aircraft performance. The resulting enriched flight intent is converted into a parametric aircraft intent description by ensuring that each flight segment closes all associated degrees of freedom of motion and of configuration of the aircraft. At least some instances of aircraft intent contain a parameter range, and the method further comprises optimizing the parametric aircraft intent by determining an optimal value for the parameter of each parameter range.

23 Claims, 9 Drawing Sheets

(56) References Cited

OTHER PUBLICATIONS

Vilaplana, M.A., et al., "Towards a Formal Language for the Common Description of Aircraft Intent", Digital Avionics Systems Conference, 2005. DASC 2005. The 24th Washington D.C., U.S.A. Oct. 30-Nov. 3, 2005, IEEE, Piscataway, N.J., U.S.A., vol. 1, Oct. 30, 2005, pp. 3.C.5-1, XP010868246, ISBN: 978-0-7803-9307-3.

Lopez-Leones, Javier, et al., "The Aircraft Intent Description Language: A Key Enabler for Air-Ground Synchronization in Trajectory-Based Operations", Digital Avionics Systems Conference,2007. DASC '07. IEEE/AIAA 26th, IEEE, PI, Oct. 1, 2007, pp. 1.D.4-1, XP031166283, ISBN: 978-1-4244-1107-8.

* cited by examiner

PROVIDING A DESCRIPTION OF AIRCRAFT INTENT

CROSS-REFERENCE TO RELATED APPLICATION

This application claims priority to and the benefit of European Patent Application No. EP 13382171.0, filed on May 9, 2013, the entire disclosure of which is expressly incorporated by reference herein.

FIELD

The present invention relates to providing a method of forming an aircraft intent description expressed using a formal language. Such a description allows the path of an aircraft to be predicted unambiguously.

BACKGROUND

The ability to predict an aircraft's trajectory is useful for several reasons. By trajectory, a four-dimensional description of the aircraft's path is meant, for example the three-dimensional position of the aircraft may be specified at each of a series of points in time. The description may be the evolution of the aircraft's state with time, where the state may include the position of the aircraft's centre of mass and other aspects of its motion such as velocity, attitude and weight.

Air traffic management (ATM) would benefit from an improved ability to predict an aircraft's four-dimensional trajectory. Air traffic management is responsible for the safe separation of aircraft, a particularly demanding task in congested airspace such as around airports. ATM decision-support tools based on accurate four-dimensional trajectory predictions could allow a greater volume of aircraft to be handled while maintaining safety.

The ability to predict an aircraft's four-dimensional trajectory will also be of benefit to the management of autonomous vehicles such as unmanned air vehicles (UAVs), for example in programming flight plans for UAVs as well as in commanding and de-conflicting their trajectories.

In order to predict an aircraft's four-dimensional trajectory unambiguously, one must solve a set of differential equations that model both aircraft behaviour and atmospheric conditions. Different sets of differential equations are available for use, some treating the aircraft as a six degrees of freedom of movement system and others treating the aircraft as a point mass with three degrees of freedom of movement. In addition, to solve the equations of motion, information concerning the aircraft's configuration is required as it will respond differently to control commands depending upon its configuration. Hence, further degrees of freedom of configuration may require definition that describe the configuration of the aircraft. For example, three degrees of freedom of configuration may be used to define landing gear configuration, speed brake configuration and lift devices configuration. Accordingly, aircraft intent may need to close six degrees of freedom to define an unambiguous trajectory, three degrees corresponding to motion of the aircraft in three axes and the other three degrees corresponding to aircraft configuration.

The computation process requires inputs corresponding to the aircraft intent, for example an aircraft intent description expressed using a formal language. The aircraft intent description provides enough information to predict unambiguously the trajectory that will be flown by the aircraft. The aircraft intent description is usually derived from flight intent, that is more-basic information regarding how the aircraft is to be flown but that will not provide enough information to allow an unambiguous determination of aircraft trajectory. Aircraft intent may comprise information that captures basic commands, guidance modes and control inputs at the disposal of the pilot and/or the flight management system, and these are expressed as a formal language in the aircraft intent description.

Aircraft intent must be distinguished from flight intent. Flight intent may be thought of as a generalisation of the concept of a flight plan, and so will reflect operational constraints and objectives such as an intended or required route and operator preferences, and may be expressed using a formal language. An instance of aircraft intent provides enough information to indicate how at least one of the aircraft's degrees of freedom is closed, whereas an instance of flight intent does not. For example, an instance of flight intent may correspond to climb from 32000 feet to 38000 feet thus leaving how the climb is performed open, whereas an instance of aircraft intent may correspond to climb from 32000 feet to 38000 feet using a climb rate of 2000 feet per minute.

Flight intent will not unambiguously define an aircraft's trajectory, as it will contain only some of the information necessary to close all degrees of freedom. Put another way, the remaining open degrees of freedom means that there are likely to be many aircraft trajectories that could be calculated that would satisfy a given flight intent. Thus, flight intent may be regarded as a basic blueprint for a flight, but that lacks the specific details required to compute unambiguously a trajectory.

Thus additional information must be combined with the flight intent in order to close all degrees of freedom and to derive the aircraft intent that does allow an unambiguous prediction of the four-dimensional trajectory to be flown. An aircraft intent description that does not close all degrees of freedom is referred to as an open aircraft intent description.

Aircraft intent is expressed using a set of parameters presented so as to allow equations of motion to be solved. The parameters may be left open (e.g. specifying a range of allowable parameters) or may be specified as a particular value. The former is referred to as parametric aircraft intent to distinguish it from the latter where all parameters are specified with particular values that is referred to as fully closed aircraft intent. Thus, an open aircraft intent description may be completed by adding instances of parametric aircraft intent to form a parametric aircraft intent description. The parametric aircraft intent description may then be optimised by determining specific values for each parameter range to form a fully closed aircraft intent description. The theory of formal languages may be used to implement these formulations of aircraft intent: an aircraft intent description language provides the set of instructions and the rules that govern the allowable combinations that express instances of aircraft intent, and so allow a prediction of the aircraft trajectory. Similarly, a flight intent description language may allow instances of flight intent, such as constraints and objectives, to be expressed and to incorporate open aircraft intent descriptions.

EP-A-2040137, also in the name of The Boeing Company, describes aircraft intent in more detail, and the disclosure of this application is incorporated herein in its entirety by reference. EP-A-2482269, also in the name of The Boeing Company, describes flight intent in more detail, and the disclosure of this application is incorporated herein in its entirety by reference.

Currently, existing aircraft antiskid control initialization is optimized for dry runways due to the lack of input to indicate what the runway condition (e.g., the runway coefficient of friction (μ)) may be. This leads to a less than optimized wet/contaminated runway performance because the antiskid control takes longer to get initialized. The present disclosure allows for the selection of the appropriate antiskid control initialization based on the runway condition detected during touchdown/de-rotation of the aircraft.

SUMMARY

Against this background, the present invention resides in a computer-implemented method of generating an aircraft intent description expressed in a formal language that provides an unambiguous four dimensional description of an aircraft's intended motion and configuration during a period of flight. The period of flight may be all or part of a flight from takeoff to landing, and may also include taxiing on the ground. The four-dimensional description may correspond to a trajectory, for example a four-dimensional description of the aircraft's path that may be specified as the three-dimensional position of the aircraft at each of a series of points in time. The description may be the evolution of the aircraft's state with time, where the state may include the position of the aircraft's centre of mass and other aspects of its motion such as velocity, attitude or mass.

The method comprises obtaining a flight intent description corresponding to a flight plan spanning the period of flight. This flight intent description may be generated by a pilot or automatically generated by flight management software in the aircraft.

Then, the method comprises parsing the flight intent description to provide instances of flight intent that define how the period of flight is divided into flight segments. Each instance of flight intent may span either a single flight segment or an integer number of flight segments. The flight segments together span the period of flight. Thus the instances of flight intent contained in the flight intent description are reviewed and used to define flight segments that correspond to the time intervals for which the instance of flight intent is active. Thus, the period of flight is divided into a series of flight segments with the boundaries between flight segments corresponding to an instance of flight intent becoming active or expiring. Ensuring that the parsing has been done may correspond to checking that the received flight intent description has been parsed in this way, or it may correspond to performing the parsing.

For each flight segment, the method comprises generating an associated flight segment intent dataset that includes one or more instances of open aircraft intent. Such a description provides information to guide how certain degrees of freedom of motion and/or configuration may be closed during the flight segment. The period of time for which each instance of flight intent is active is generally referred to herein as its execution interval. Each flight segment is described by the flight segment intent dataset that in general will comprise multiple instances of open aircraft intent. For example, a flight segment intent dataset may comprise an instance of open aircraft intent that is relevant to the vertical path and another instance of open aircraft intent that is relevant to the lateral path.

The method sees an enrichment of the basic flight intent description with additional information. This enrichment is performed over at least three steps.

First, a step of user preferences based enrichment is performed that comprises comparing flight segment intent datasets with constraints and/or objectives stored in a user preferences database. Constraints and/or objectives that are relevant to the flight segment intent dataset are identified, and the flight intent description is enriched with information describing the identified constraints and/or objectives thereby providing an enriched flight intent description. This information may be added as new instances of flight intent or by amending existing instances of flight intent. User preferences based enrichment is performed according to a user preferences enrichment strategy.

Second, a step of operational context based enrichment is performed that comprises comparing flight segment intent datasets with constraints and/or objectives stored in an operational context database. Constraints and/or objectives that are relevant to the flight segment intent dataset are identified, and the flight intent description is enriched with information describing the identified constraints and/or objectives thereby providing a further enriched flight intent description. This information may be added as new instances of flight intent or by amending existing instances of flight intent. Operational context based enrichment is performed according to an operational context enrichment strategy.

Third, a step of aircraft performance based enrichment is performed that comprises comparing flight segment intent datasets with constraints and/or objectives stored in an aircraft performance database. Constraints and/or objectives that are relevant to the flight segment intent dataset are identified, and the flight intent description is enriched with information describing the identified constraints and/or objectives thereby providing a still further enriched flight intent description. This information may be added as new instances of flight intent or by amending existing instances of flight intent. This may be performed according to an aircraft performance enrichment strategy.

Next, the method comprises a step of completing the open aircraft intent description extracted from the flight segment intent dataset. This completion comprises converting the instances of open aircraft intent contained in the flight segment intent datasets of the still further enriched flight intent description into instances of parametric aircraft intent by identifying flight segment intent datasets where not all degrees of freedom are closed and completing the identified flight segment intent datasets by adding one or more instances of aircraft intent to close all degrees of freedom. The instances of aircraft intent may be instances of parametric aircraft intent or may be instances of aircraft intent that provide specific parameter values. This is performed according to a completion strategy selected from a plurality of stored completion strategies and adding instances of aircraft intent corresponding to that completion strategy. The completion strategy considers those constraints and/or objectives affecting the flight segment and selects an appropriate sequence of maneuvers, expressed in terms of aircraft intent, to fulfil them. The flight segment intent datasets are collated thereby providing the parametric aircraft intent description for the period of flight expressed in a formal language. The step of adding instances of aircraft intent includes providing instances of parametric aircraft intent thereby forming the parametric aircraft intent description.

During any of the three enrichment steps, the instances of open aircraft intent included in the flight segment intent datasets may be enriched with enough information such that all degrees of freedom are closed. In such cases, the completion step is unnecessary.

After completion, a step of optimising the parametric aircraft intent description is performed that comprises determining an optimal value for the parameter of each parameter range according to an optimisation strategy thereby generating the fully closed aircraft intent description.

Thus, the present invention provides a three-stage method of enriching a flight intent description. First, the flight intent description is enriched using user preferences. Second, the enriched flight intent description is further enriched using operational context. This is performed by identifying objectives and/or constraints relevant to the enriched flight intent description. Consequently, this process is guided by the information already added to the flight intent description during the user preferences based enrichment. Then, the further enriched flight intent description is still further enriched using aircraft performance. This is performed by identifying objectives and/or constraints relevant to the further enriched flight intent description, and so is guided by the information added according to user preferences and operational context.

Therefore, a hierarchy exists where user preferences take precedence over operational context and, in turn, operational context takes precedence over aircraft performance. That is, user preferences are first used to guide the conversion of flight intent into the fully closed aircraft intent. Then operational context is used to guide the conversion, but this is influenced by the user preferences already incorporated into the flight intent description. Lastly, aircraft performance is used to enrich the flight intent description as applicable to the user preferences and operational context already incorporated into the flight intent description. This structured approach has been found beneficial.

The method may comprise checking to determine whether a fully closed aircraft intent description is generated that fulfils all constraints (and optionally objectives) contained in the still further enriched flight intent description provided by the aircraft performance based enrichment.

If a fully closed aircraft intent description cannot be generated to fulfil all objectives and constraints contained in the still further enriched flight intent description provided by the aircraft performance based enrichment, the method may first comprise performing optimisation loops comprising iteratively repeating the step of optimising the parametric aircraft intent description according to alternative optimisation strategies. These iterations are repeated at least until a fully closed aircraft intent description is generated that fulfils all objectives and constraints contained in the still further enriched flight intent description provided by the aircraft performance based enrichment. Further loops may be performed to provide alternative aircraft intent descriptions that satisfy all constraints and/or objectives.

If, after performing the optimisation loops, a fully closed aircraft intent description cannot be generated to fulfil all objectives and constraints contained in the still further enriched flight intent description provided by the aircraft performance based enrichment, the method may further comprise performing completion loops comprising iteratively repeating the step of completing the open aircraft intent description with parametric aircraft intent according to alternative completion strategies. During each iteration of the completion loop, the method may comprise performing the optimisation loops. The iterations of the completion loops and the optimisation loops continue until a fully closed aircraft intent description is generated that fulfils all objectives and constraints contained in the still further enriched flight intent description provided by the aircraft performance based enrichment. Further loops may be performed to provide alternative fully closed aircraft intent descriptions that satisfy all constraints and/or objectives.

If, after performing the completion loops, a fully closed aircraft intent description cannot be generated to fulfil all objectives and constraints contained in the still further enriched flight intent description provided by the aircraft performance based enrichment, the method may further comprise performing operational context loops comprising iteratively repeating the step of operational context based enrichment according to alternative operational context enrichment strategies followed by the step of aircraft performance based enrichment. During each iteration of the operational context loop, the method may comprise performing the completion loops as described above until a fully closed aircraft intent description is generated that fulfils all objectives and constraints contained in the still further enriched flight intent description provided by the aircraft performance based enrichment. Further loops may be performed to provide alternative aircraft intent descriptions that satisfy all constraints and/or objectives.

If, after performing the operational context loops, a fully closed aircraft intent description cannot be generated to fulfil all objectives and constraints contained in the still further enriched flight intent description provided by the aircraft performance based enrichment, the method may comprise performing user preferences loops comprising iteratively repeating the step of user preferences based enrichment according to alternative user preferences enrichment strategies. During each iteration of the user preferences loop, the method may comprise performing the operational context loops as described above until a fully closed aircraft intent description is generated that fulfils all objectives and constraints contained in the still further enriched flight intent provided by the aircraft performance based enrichment. Further loops may be performed to provide alternative fully closed aircraft intent descriptions that satisfy all constraints and/or objectives.

The loops described above seek to ensure a fully closed aircraft intent description is generated that meets all constraints and/or objectives. This is done while still preserving the hierarchy described above. That is, user preferences are altered only as a last resort as the user preferences loop is the last loop to be tried when attempting to meet all constraints and/or objectives. The penultimate loop is the operational context loop, again preserving the operational context in its position in the hierarchy. The method preferentially tries different optimisation strategies as a first resort, and then tries different completion strategies. Only when these fail does the method progress to trying different operational context strategies and user preferences strategies that might see less preferred trajectories arise.

The step of completing the instances of open aircraft intent within the flight segment intent datasets comprises identifying completion strategies by the degrees of freedom they influence, and selecting a completion strategy to close a degree of freedom in an identified flight segment from the strategies identified to influence that degree of freedom. Optionally, the method comprises identifying completion strategies by a phase of flight to which they apply, and selecting a completion strategy to close a degree of freedom from the strategies identified to influence that degree of freedom and identified to apply to the phase of flight associated with the identified flight segment.

At least some flight segment intent datasets contain an instance of parametric aircraft intent with a parameter range. The method further comprises optimising the parametric aircraft intent description by determining an optimal value for the parameter of each parameter range. Determining the optimal values may comprise generating initial parameter values thereby forming a model fully closed aircraft intent description and calculating a trajectory from the model fully closed aircraft intent description. Then, a merit function value for the trajectory may be calculated using a merit function. This may be followed by repeated iterations of amending the parameter values, calculating the resulting trajectory and calculating the resulting merit function value to determine whether the fully closed aircraft intent description is improved, thereby optimising the parameter values by improving the merit function value. Optionally, some flight segment intent datasets can be affected by one or more objectives that are relevant to the associated flight segments. These objectives may be used to form the merit function.

The user preferences database has stored therein objectives that may comprise information describing operational preferences. Objectives may correspond to user preferences and may be directed to safety and efficiency. The user may correspond to an airline or may correspond to a pilot. The objectives may be stored in a user preferences model that comprises information describing such operational preferences. Example user preferences are: operational revenue such as maximising payload weight, minimising fuel consumption, minimising over-flight fees, minimising landing fees, minimising maintenance costs; environmental impact such as minimising COx and NOx emissions, minimising noise emissions; and quality of service such as increasing passengers' comfort (e.g. avoiding sudden and extreme maneuvers) and reducing delays.

Identifying objectives from the user preferences database that are relevant to the flight segment description may comprise identifying objectives associated with the aircraft. Identifying objectives that are relevant to the flight segment description may comprise identifying objectives associated with the aircraft by identifying objectives of the airline operating the aircraft, by identifying objectives pertaining to a phase of flight occurring during the corresponding flight segment, or by identifying objectives pertaining to airspace though which the aircraft will pass during the corresponding flight segment. This effectively filters objectives that are not relevant to the current flight segment. For example, objectives may be ignored where they do not relate to the type of the aircraft.

The operational context database has stored therein constraints that comprise restrictions on flying within an airspace. For example, the operational context database may contain details of restricted airspace, terrain and other navigational hazards, and air traffic requirements like standard terminal arrival routes (STARS) and standard instrument departures (SIDS) to be followed into and out from an airport. Identifying constraints that are relevant to the flight segment descriptions comprises identifying only those constraints affecting airspace though which the aircraft will pass during the corresponding flight segment.

In general, a description of a set of initial conditions of the aircraft at the start of the period of flight will be needed. This description of the initial conditions may be part of the flight intent description obtained. Alternatively, the method may further comprise obtaining a description of a set of initial conditions of the aircraft at the start of the period of flight and ensuring that the flight intent description and the initial conditions are parsed to provide the open aircraft intent description.

As noted above, instances of flight intent and aircraft intent may include information and descriptions of aircraft configuration. The aircraft configuration may be grouped into degrees of freedom that require definition in the aircraft intent. For example, three degrees of freedom of configuration may be required, one degree defining the configuration of the landing gear, one degree defining the configuration of high lift devices such as flaps, and one degree defining the configuration of the speed brakes. Landing gear may be defined as either stowed or deployed, and the speed brakes may also be defined as stowed and deployed. High lift configurations may have many more states, for example corresponding to stowed and several extended positions.

Consequently, an aircraft may be defined by aircraft intent having six degrees of freedom, namely three degrees of freedom of motion, and three degrees of freedom of configuration corresponding to landing gear, high lift devices and speed brakes.

The three degrees of freedom of motion may comprise one degree corresponding to the lateral profile and two degrees corresponding to the vertical profile. To close the two degrees relating to the vertical profile, flight intent may be required that provides a description of two out of the following three aspects of aircraft motion: vertical path, speed and propulsion.

Objectives may relate to aircraft configuration. For example, a flight segment corresponding to climb out after take off may have an objective to minimise noise foot print, which might require actions on the aircraft configuration.

Any of the above methods may further comprise calculating a trajectory for the period of flight from the fully closed aircraft intent description for use in a variety of applications. For example, the trajectory may be made available to a pilot for inspection. Alternatively, the aircraft may be made to fly the trajectory either manually by a pilot or automatically by an autopilot. The fully closed aircraft intent description and resulting trajectory may be used by air traffic control. For example, air traffic control may compare trajectories found in this way to identify conflicts between aircraft.

As will be appreciated from the above, computers and computer processors are suitable for implementing the present invention. The terms "computer" and "processor" are meant in their most general forms. For example, the computer may correspond to a personal computer, a mainframe computer, a network of individual computers, laptop computers, tablets, handheld computers like PDAs, or any other programmable device. Moreover, alternatives to computers and computer processors are possible. Programmed electronic components may be used, such as programmable logic controllers. Thus, the present invention may be implemented in hardware, software, firmware, and any combination of these three elements. Further, the present invention may be implemented in the computer infrastructure of an aircraft, or on a computer readable storage medium having recorded thereon a computer program comprising computer code instructions, when executed on a computer, cause the computer to perform one or more methods of the invention. All references above to computer and processor should be construed accordingly, and with a mind to the alternatives described herein.

Other aspects of the invention, along with preferred features, are set out in the appended claims.

DRAWINGS

In order that the present invention may be more readily understood, preferred embodiments will now be described, by way of example only, with reference to the accompanying drawings in which.

DESCRIPTION

Figure 1:
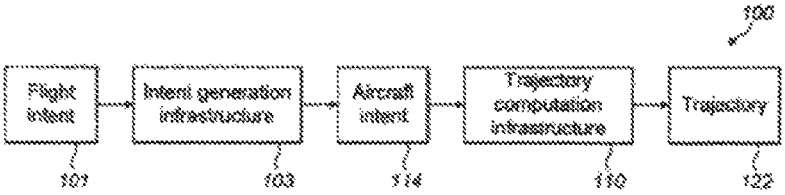
FIG. 1 shows a system for computing an aircraft's trajectory using descriptions of flight intent and aircraft intent.
Figure 2:
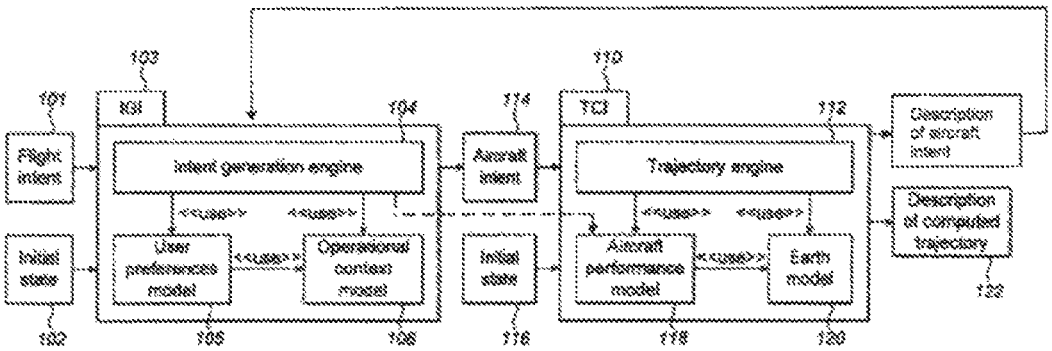
FIG. 2 shows the system of FIG. 1 in greater detail.

A system for computing an aircraft's trajectory 100 from a description of aircraft intent 114 that is in turn derived from a description of flight intent 101 is shown in FIGS. 1 and 2.

FIG. 1 shows a basic structure of how flight intent may be used to derive aircraft intent, and how an aircraft intent description 114 may be used to derive a description of an aircraft's trajectory 122. In essence, a flight intent description 101 is provided as an input to an intent generation infrastructure 103. The intent generation infrastructure 103 determines aircraft intent using the instructions provided by the flight intent 101 and other inputs to ensure a set of instructions is provided as the aircraft intent description 114 that will allow an unambiguous trajectory 122 to be calculated. This process may comprise intermediate steps of enriching the flight intent 101 and completing the enriched flight intent to provide a parametric aircraft intent description, before finally optimising the parametric aircraft intent description to produce the fully closed aircraft intent description 114.

The fully closed aircraft intent description 114 output by the intent generation infrastructure 103 may then be used as an input to a trajectory computation infrastructure 110. The trajectory computation infrastructure 110 calculates an unambiguous trajectory 122 using the fully closed aircraft intent 114 and other inputs that are required to solve the equations of motion of the aircraft.

FIG. 2 shows the system of FIG. 1 in further detail. As can be seen, the intent generation infrastructure 103 receives a flight intent description 101 as an input along with a description of the initial state 102 of the aircraft (the initial state 102 of the aircraft may be defined as part of the flight intent description 101, in which case these two inputs are effectively one and the same). The intent generation infrastructure 103 comprises an intent generation engine 104 and a pair of databases, one storing a user preferences model 105 and one storing an operational context model 106.

The user preferences model 105 embodies the preferred operational strategies governing the aircraft and may correspond to both constraints and objectives, e.g. the preferences of an airline with respect to routes; speeds; aircraft configuration such as flap deployment times and landing gear deployment times; loads (both payload and fuel); how to react to meteorological conditions such as temperature, wind speeds, altitude, jet stream, thunderstorms and turbulence as this will affect the horizontal and vertical path of the aircraft as well as its speed profile; cost structure such as minimising time of flight or cost of flight, maintenance costs, environmental impact; communication capabilities; and security considerations. The user preferences model 105 may be used when converting the flight intent description 101 to the fully closed aircraft intent output 114—in enriching the flight intent in completing the open aircraft intent description, or in optimising the parametric aircraft intent—by providing further detail, as will be described in more detail below.

The operational context model 106 embodies constraints on use of airspace. For example, the operational context model 106 may contain details of restricted airspace and of air traffic requirements like standard terminal arrival routes (STARS) and standard instrument departures (SIDS) to be followed into and out from an airport. The operational context model 106 is also used when converting the flight intent description 101 into the fully closed aircraft intent description 114—in enriching the flight intent in completing the open aircraft intent description, or in optimising the parametric aircraft intent description—by providing further detail, as will be described in more detail below.

The intent generation engine 104 uses the flight intent description 101, initial state description 102, user preferences model 105 and operational context model 106 to convert the flight intent description 101 the fully closed aircraft intent 114 as its output. The intent generation engine 104 may also use an aircraft performance model 118 when converting the flight intent description 101 into the fully closed aircraft intent description 114 (as shown by the dashed line in FIG. 2). As will become apparent from the below, using the aircraft performance model 188 allows the intent generation engine 104 to check to ensure that the proposed fully closed aircraft intent description 114 is feasible from the aircraft's perspective (i.e. that the aircraft is capable of flying the associated trajectory).

FIG. 2 shows that the trajectory computation infrastructure 110 comprises a trajectory engine 112. The trajectory engine 112 requires as inputs both the fully closed aircraft intent description 114 described above and also the initial state description 116. The initial state description 116 may be defined as part of the aircraft intent description 114 in which case these two inputs are effectively one and the same. For the trajectory engine 112 to provide a description of the computed trajectory 122 for the aircraft, the trajectory engine 112 uses databases comprising two models: an aircraft performance model 118 and an Earth model 120.

The aircraft performance model 118 provides the values of the aircraft performance aspects required by the trajectory engine 112 to integrate the equations of motion. These values depend on the aircraft type for which the trajectory is being computed, the aircraft's current motion state (position, velocity, weight, etc) and the current local atmospheric conditions.

In addition, the performance values may depend on the intended operation of the aircraft, i.e. on the aircraft intent. For example, a trajectory engine 112 may use the aircraft performance model 118 to provide a value of the instantaneous rate of descent corresponding to a certain aircraft weight, atmospheric conditions (pressure altitude and temperature) and intended speed schedule (e.g. constant calibrated airspeed). The trajectory engine 112 will also request from the aircraft performance model 118 the values of the applicable limitations so as to ensure that the aircraft motion remains within the flight envelope. The aircraft performance model 118 is also responsible for providing the trajectory engine 112 with other performance-related aspects that are intrinsic to the aircraft, such as flap and landing gear deployment times. As noted above, the intent generation engine 104 may also use the aircraft performance model 118 to ensure that the fully closed aircraft intent description 114 it will propose is feasible from the aircraft's perspective.

The Earth model 120 provides information relating to environmental conditions, such as the state of the atmosphere, weather conditions, gravity and magnetic variation.

The trajectory engine 112 uses the inputs 114 and 116, the aircraft performance model 118 and the Earth model 120 to solve a set of equations of motion. Many different sets of equations of motion are available that vary in complexity, and that may reduce the aircraft's motion to fewer degrees of freedom by means of a certain set of simplifying assumptions. For example, equations of motion describing aircraft motion in six degrees of freedom of motion may be used. A simplified set of equations of motion may use only three degrees of freedom of motion.

Thus, the trajectory engine 112 provides as an output a description of the computed trajectory 122. This may be a graphical description of the trajectory, for example rendered on a display. Alternatively, the description of the computed trajectory 122 may be a textual description, including a computer file from which a graphical display may be generated later.

The trajectory engine 112 also provides as an output a description of the aircraft intent 123. This may be the same as the aircraft intent 114 received as an input. This description 123 is sometimes used by the intent generation engine 104 for developing further versions of aircraft intent, as will be described in more detail below.

The trajectory computation infrastructure 110 may be air-based or land-based. For example, the trajectory computation infrastructure 110 may be associated with an aircraft's flight management system that controls the aircraft on the basis of a predicted trajectory that captures the airline operating preferences and business objectives. The primary role for land-based trajectory computation infrastructures 120 is for air traffic management.

Using a standardised approach to describing an aircraft's trajectory allows greater interoperability between airspace users and managers. It also allows greater compatibility between many of the legacy software packages that currently predict trajectories, even if interpreters are required to convert information from the standard format into a proprietary format.

Moreover, a standardised approach also works to the benefit of flight intent and aircraft intent. For example, flight intent may be expressed using the instructions and other structures of the formal language implementation used to express aircraft intent in the aircraft intent description 114. In addition, flight intent provides a user with an extension to the aircraft intent language that allows flight intent to be formulated where only certain aspects of aircraft's motion are known. By using a common expression format, these instances of flight intent may be easily enriched, add to using instances of aircraft intent during completion and then optimised to form the fully closed aircraft intent description 114.

As flight intent may be thought of as a broader and generalised form of aircraft intent, it is useful to start with a consideration of aircraft intent such that key concepts also used in generating flight intent may be introduced.

Aircraft Intent

The fully closed aircraft intent description 114 is an expression of a set of instructions in a formal language, an aircraft intent description language, which defines unambiguously the trajectory 122 of the aircraft. This expression is used by the trajectory computation engine 112 to solve the equations of motion that govern the aircraft's motion. To solve the equations, the configuration of the aircraft must be specified also. For example, configuration information may be required to resolve the settings of the landing gear, speed brakes and high lift devices. Hence, the aircraft intent 114 comprises a set of instructions including both configuration instructions that describe completely the aerodynamic configuration of the aircraft and motion instructions that describe unambiguously how the aircraft is to be flown and hence the resulting motion of the aircraft. As the motion instructions and the configuration instructions are both required to define uniquely the aircraft's motion, they are together referred to herein as the instructions defining the degrees of freedom: motion instructions relate to the degrees of freedom of motion and configuration instructions relate to the degrees of freedom of configuration. For example, six degrees of freedom may be used to describe the aircraft such as lateral path (motion), vertical path (motion), speed (motion), landing gear (configuration), high lift devices (configuration) and speed brakes (configuration).

There exist in the art many different sets of equations of motion that may be used to describe an aircraft's motion. The sets of equations generally differ due to their complexity. In principle, any of these sets of equations may be used with the present invention. The actual form of the equations of motion may influence how the aircraft intent description language is formulated because variables that appear in the equations of motion also appear in the instructions that correspond to instances of aircraft intent. However, instances of flight intent are not constrained in this way in that they may express flight intent generally. Any detail specific to the particular equations of motion to be used need not be specified in the instances of flight intent, and may be added when forming the parametric aircraft intent description.

The aircraft intent description language is a formal language whose primitives are the instructions. The grammar of the formal language provides the framework that allows individual instructions to be combined into composites and then into sentences that can be used to describe flight segments. Each flight segment has an associated flight segment intent dataset that contains a set of instructions describing the aircraft and its motion during the flight segment. In the open aircraft intent descriptions, some degrees of freedom of motion and/or configuration are left open. However, in the fully closed aircraft intent description 114, each flight segment intent dataset contains a complete set of instructions that close all the degrees of freedom of motion and so unambiguously defines the aircraft trajectory 122 over the associated flight segment.

Instructions may be thought of as indivisible pieces of information that capture basic commands, guidance modes and control inputs at the disposal of the pilot and/or the flight management system. Each instruction may be characterised by three main features: effect, meaning and execution interval. The effect is defined by a mathematical description of its influence on the aircraft's motion. The meaning is given by its intrinsic purpose and is related to the operational purpose of the command, guidance mode or control input captured by the instruction. The execution interval is the period during which the instruction is affecting the aircraft's motion. The execution of compatible instructions may overlap, while incompatible instructions cannot have overlapping execution intervals (e.g. instructions that cause a conflicting requirement for the aircraft to ascend and descend would be incompatible).

Lexical rules capture all the possible ways of combining instructions into the aircraft intent descriptions (namely the open, parametric and fully closed aircraft intent descriptions)

such that overlapping incompatible instructions are avoided and so that the aircraft trajectory is unambiguously defined.

Flight Intent

The definition of a specific aircraft trajectory is the result of a compromise between a given set of objectives to be met and a given set of constraints to be followed. These constraints and objectives are to some extent included as part of the flight intent description 101 that could be considered as a flight blueprint. Further constraints and objectives are added during the enrichment process. Importantly, flight intent does not have to determine the aircraft motion unambiguously: in principle, there may be many trajectories that fulfil the set of objectives and constraints encompassed by a given fully closed flight intent description 101. Any flight intent description may generally give rise to a family of fully closed aircraft intents descriptions 114, each fully closed aircraft intent description 114 fulfilling the flight intent's objectives and constraints and resulting in a different unambiguous trajectory. For example, an instance of flight intent may define a lateral path to be followed over a flight segment but may not specify a vertical path to be followed over the same execution interval: many instances of aircraft intent could be generated from this instance of flight intent, each instance of aircraft intent corresponding to a different vertical profile through the flight segment.

Thus, the flight intent description 101 must normally be enriched with enough information to allow a unique aircraft intent to be determined and thus a unique trajectory. Enriching the flight intent description 101 and completing the open aircraft intent with parametric aircraft intent, and obtaining through an optimization process the fully closed aircraft intent is the responsibility of the intent generation engine 104, whereas the trajectory engine 112 assumes responsibility for determining the corresponding trajectory 122 from the fully closed aircraft intent description 114.

As explained above, the flight intent description 101 contains trajectory-related information that does not necessarily univocally determine the aircraft motion, but instead usually incorporates a set of high-level conditions that define certain aspects that the aircraft should respect during its motion (e.g. following a certain route, keeping a fixed speed in a certain area). The flight intent is enriched with key operational objectives and constraints that must be fulfilled by the trajectory (e.g. intended route, operator preferences, standard operational procedures, air traffic management constraints, etc.) by reference to the user preferences model 105 and the operational context model 106. The aircraft performance model 118 may also be used to enrich the flight intent.

Considering the information that is used directly to generate and enrich the flight intent, it is possible to group similar elements into four separate structures: flight segments, operational context, user preferences and aircraft performance.

The flight segments combine to form the flight path to be followed by the aircraft during the flight, i.e. the four-dimensional trajectory is made up of a series of successive flight segments. As explained above with respect to the operational context model 106, the operational context may include the set of air traffic management constraints that may limit the trajectory followed by an aircraft in one or more dimensions. They may include altitude constraints, speed constraints, climb/descend constraints, heading/vectoring/route constraints, standard procedures constraints, route structures constraints, SID constraints, STAR constraints, and coordination and transfer constraints (e.g. speed and altitude ranges and the location of entrance and exit points which should be respected by any flight when it is moving from one sector to the next). These constraints may be retrieved from the operational context model 106 and used to enrich the flight intent 101.

As explained above with respect to the user preferences model 105, user preferences are usually directed to safety and efficiency, and generally differ from one user (such as an airline or pilot) to another. The most common user preferences relate to: preferred routes; preferred aircraft configuration including deployment times; increasing operational revenue such as maximising payload weight to be flown, minimising fuel consumption, minimising over-flight fees, minimising landing fees, and minimising maintenance costs; environmental impact such as minimising COx and NOx emissions, minimising noise emissions; and quality of service such as increasing passengers' comfort (e.g. avoiding sudden and extreme maneuvers, avoiding turbulence) and reducing delays. These preferences may correspond to constraints or objectives. These constraints and objectives may be retrieved from the user preferences context model 105 and used to enrich the flight intent.

As explained above with respect to the aircraft performance model 118, aircraft performance includes values like the aircraft type, aircraft weight, performance values like fuel burn, drag, time, response times (e.g. to roll commands), limitations so as to ensure that the aircraft motion remains within the flight envelope (e.g. maximum and minimum speeds) and other performance-related aspects such as flap and landing gear deployment times. These performance aspects may correspond to constraints. For example, performance limitations may be used as constraints like a constraint not to exceed a certain bank angle. These constraints may be retrieved from the aircraft performance model 118 and used to enrich the flight intent.

Flight Intent Description Language (FIDL)

It is proposed to represent flight intent using a formal language, composed of a non-empty finite set of symbols or letters, known as an alphabet, which is used to generate a set of strings or words. A grammar is also required, namely a set of rules governing the allowable concatenation of the alphabet into strings and the strings into sentences.

Figure 3:
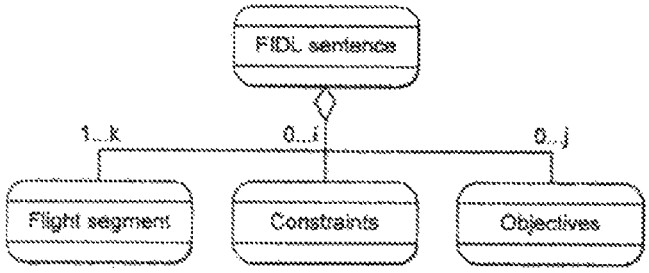
FIG. 3 shows elements of the flight intent description language.

The alphabet comprises three types of letters, as shown in FIG. 3: flight segment descriptions, constraints and objectives. A sentence is formed by the proper combination of these elements following grammatical rules that will be described below. A sentence is an ordered sequence of flight segment descriptions, i.e. ordered according to when they occur, in which different constraints and objectives are active to influence the aircraft motion.

Flight segment descriptions, within the alphabet, are a description of the instances of flight intent active during the flight segment and represent the intent of changing the aircraft motion state from one state into another (e.g. a translation from one 3D point to another 3D point, a turning between two courses, an acceleration between two speeds or an altitude change). A flight segment may be characterised in its flight segment description by two aircraft motion states identified by a condition or event that establishes certain requirements for the trajectory to be flown between these states. These conditions, or triggers, represent the execution interval of the flight segment. The flight segment intent dataset associated with these triggers may close one or more degrees of freedom during the flight segment, including both degrees of freedom of motion and of configuration.

Constraints represent restrictions on the trajectory, as described above, and the constraints may be achieved by making use of the open degrees of freedom that are available during the applicable flight segment(s).

Objectives, as described above, represent a desire relating to the trajectory to maximize or minimize a certain functional (e.g. cruise to minimise cost). The objectives may be achieved by making use of the open degrees of freedom that are available during the applicable flight segment(s), excluding those that are used to respect the constraints affecting that flight segment(s).

Combining these three elements it is possible to build words as valid FIDL strings. For example, the flight intent information "fly from waypoint RUSIK to waypoint FTV" can be expressed by an FIDL word containing a flight segment intent dataset whose initial state is defined by the coordinates of waypoint RUSIK and whose final state is defined by the coordinates of waypoint FTV. This flight segment intent dataset could be enriched by a constraint such as "maintain flight level above 300 (FL300)". In the same way, it would be possible to add information to this FIDL word regarding some objectives over the trajectory such as maximise speed. To ensure that any constraint or objective is compatible with a flight segment intent dataset, the affected aspect of aircraft motion or configuration, expressed as a degree of freedom, should not have been previously closed. In the previous example, the flight level constraint is compatible with the description of the flight segment because the flight segment intent dataset does not define any vertical behaviour. Often constraints and objectives will extend over a sequence of flight segments and so are added to multiple flight segment intent dataset.

The attributes of a flight segment intent dataset are effect, execution interval and a flight segment code. The effect provides information about the aircraft behaviour during the flight segment, i.e., it is an open aircraft intent, and could range from no information to a complete description of how the aircraft is flown during that flight segment. The effect is characterised by a composite which is an aggregated element formed by groups of aircraft intent description language (AIDL) instructions or is a combination of other composites, but need not meet the requirement for all degrees of freedom to be closed.

Figure 4:
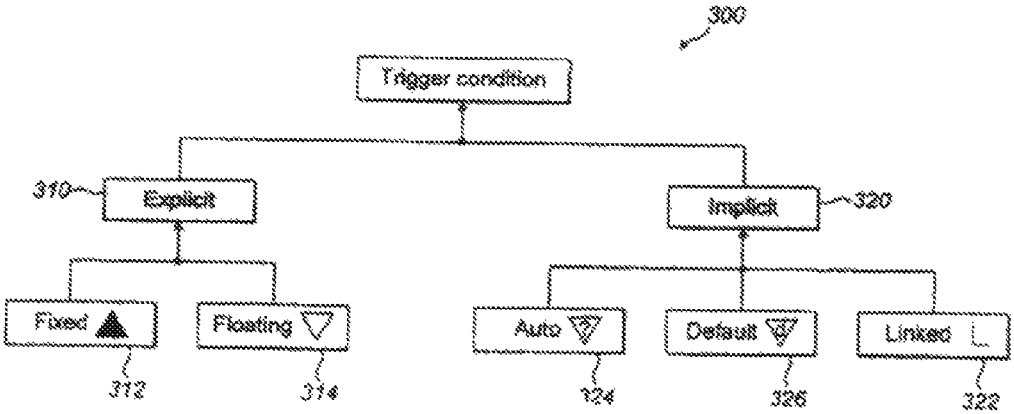
FIG. 4 is a diagram showing the different types of trigger conditions.

The execution interval defines the interval during which the flight segment description is active, fixed by means of the begin and end triggers. The begin and end triggers may take different forms, as indicated in FIG. 4. Explicit triggers 310 are divided into fixed 312 and floating 314 triggers. Fixed triggers 312 correspond to a specified time instant for starting or ending an execution interval such as to set an airspeed at a fixed time. Floating triggers 314 depend upon an aircraft state variable reaching a certain value to cause an execution interval to start or end, such as keep airspeed below 250 knots until altitude exceeds 10,000 feet. Implicit triggers 320 are divided into linked 322, auto 324 and default 326 triggers. A linked trigger 322 is specified by reference to another flight segment, for example by starting when triggered by the end trigger of a previous flight segment. Auto triggers delegate responsibility for determining whether the conditions have been met to the trajectory computation engine 112, for example when conditions are not known at the intent generation time, and will only become apparent at the trajectory computation time. Default triggers represent conditions that are not known at intent generation, but are determined at trajectory computation because they rely upon reference to the aircraft performance model.

Constraints could be self-imposed by the aircraft operator such as avoid over-flight fees (in which case information relating to the constraints are stored in the user preferences model 105), by the operational context or by air traffic management such as follow a STAR flight path (in which case information relating to the constraints are stored in the operational context model 106), or by performance limitations of the aircraft (in which case information relating to the constraints are stored in the aircraft performance model 118). In any case, the final effect over the aircraft motion will be a limitation on the possible aircraft behaviour during a certain interval. Constraints may be classified according to the degree(s) of freedom affected by the constraint which is useful when determining whether it can be applied to a flight segment intent dataset (i.e. when determining whether that degree of freedom is open and so available).

Objectives are defined as a functional that can be combined into a merit function whose optimisation drives the process of finding the most appropriate trajectory. The functional may define explicitly the variable or variables used for the optimisation (e.g. altitude, climb rate, turn radius), and may return the value for them that minimises or maximises the functional. The variables of control are related to the degrees of freedom used to achieve the functional. Therefore, they specify the intention of using one or more degrees of freedom to achieve the optimisation. When no variable of control is defined, the intent generation process will use any remaining open degree of freedom to achieve the optimisation. Objectives may be classified considering the degree of freedom that can be affected by the objective effect.

The FIDL grammar is divided in lexical and syntactical rules. The former contains a set of rules that governs the creation of valid words using flight segment descriptions, constraints and objectives. The latter contains a set of rules for the generation of valid FIDL sentences.

The lexical rules consider the flight segment descriptions as the FIDL lexemes, i.e. the minimal and indivisible element that is meaningful by itself. Constraints and objectives are considered as FIDL prefixes (or suffixes) which complement and enhance the meaning of the lexemes but do not have any sense individually. Therefore the lexical rules describe how to combine the lexemes with the prefixes in order to ensure the generation of a valid FIDL string. They also determine whether a string formed by lexemes and prefixes is valid in the FIDL.

The lexical rules are based on the open and closed degrees of freedom that characterise a flight segment. If the flight segment has no open degree of freedom, it means that the associated lexemes are totally meaningful and their meaning cannot be complemented by any prefix (constraint or objective). For lexemes whose flight segments have one or more open degrees of freedom, as many prefixes as open degrees of freedom may be added.

The FIDL syntactical rules are used to identify if a sentence formed by FIDL words is valid or not. A well-formed FIDL sentence is defined by a sequence of concatenated flight segment intent datasets, enriched with constraints and objectives, that represent a chronological succession of aircraft motion states during a period of flight.

Generation of Aircraft Intent

A method of generating aircraft intent will now be described with reference to FIG. 5.

At step 510, the intent generation infrastructure 103 is initialised to create or obtain a flight intent description 101 to be used in a specific operational context, for a specific user and for a specific aircraft model.

At step 520, the flight intent description 101 and initial conditions 102 are parsed by the intent generation infrastructure 103 to create flight segments and corresponding flight segment intent datasets containing instances of open aircraft intent to span each flight segment. In some embodiments, the parsed flight intent will contain flight segment intent datasets already augmented by constraints or objectives, for example as already provided by an operator when defining the original flight intent as part of a mission plan or the like.

The parsed flight intent is provided to the intent generation engine 104 so that it may be converted to a fully closed aircraft intent description 114. The intent generation engine 104 has at its disposal a set of strategies and heuristics to allow it to convert the original flight intent into a fully closed aircraft intent description 114 by adding information to the flight segment intent datasets to close all degrees of freedom. This process comprises steps 530 to 560 shown in summary in FIG. 5, and as shown in more detail in FIGS. 6 to 10.

At step 530, the intent generation engine 104 uses the user preferences model 105, the operational context model 106 and the aircraft performance model 118 to enrich the flight intent description. The intent generation engine 104 identifies constraints and objectives from the models 105, 106 and 118 that are relevant to the flight segments (e.g. not all the constraints included in the operational context are likely to apply to a specific route or to all flight segments on a particular flight path). How relevant constraints and objectives are identified is described in more detail below. The intent generation engine 104 enriches the flight intent by expanding the flight segment intent datasets either by adding further instances of flight segments or by amending the existing instance of flight intent such that the resulting instance of flight intent specifies the relevant constraints and objectives according to the syntactical and lexical rules imposed by the flight intent description language. The output of step 530 is an enriched flight intent description.

At step 540, the intent generation engine 104 identifies flight segment intent datasets of the enriched flight intent description having open degrees of freedom. The intent generation engine 104 fills these datasets with instances of aircraft intent, such as composites, to close all degrees of freedom. The instances of aircraft intent may contain some instances of parametric aircraft intent. This process is driven by several completion strategies based on the sequence and type of any constraints included in the enriched flight intent description. In general, constraints will not cause a particular parameter to be uniquely specified, but instead usually set a range of parameters. For example, a constraint added to a flight segment intent dataset may specify a maximum airspeed to be flown leaving open a range of airspeed parameters. Hence, completion usually comprises adding instances of parametric aircraft intent.

At step 550, the intent generation engine 104 optimises the parametric aircraft intent description. This optimisation process takes all the parameter ranges specified in the parametric aircraft intent description, and calculates optimal values for each parameter by optimising an overall merit function that is calculated from all the objectives present in the enriched flight intent description. The parametric ranges specified in each instance of parametric aircraft intent are then replaced by the optimal values.

At the end of the optimisation step 550, the method proceeds to step 560 where the intent generation engine 104 uses the trajectory engine 112 to generate the corresponding trajectory and to check that the predicted trajectory for the fully closed aircraft intent description fulfils all constraints defined by the operational context model 106, user preferences model 105, aircraft performance model 118 and the flight intent 101.

If all constraints are fulfilled, the method ends at step 570 where the fully closed aircraft intent description 123 is provided and/or a description of the corresponding trajectory 122 is provided. If any constraints are found not to be fulfilled, the method returns to step 540 where the original enriched flight intent description provided at step 530 is retrieved and the intent generation engine 104 uses an alternative strategy to complete the instances of open aircraft intent by inserting composites. The method then continues as before through steps 550 and 560.

A number of iterations of the loop may be performed in an attempt to find a solution. For example, strategies may be ranked such that the intent generation engine 104 selects strategies in turn according to rank until a fully closed aircraft intent description 114 is formed that is found to meet all constraints at step 560. Should the alternative strategies available at step 540 that see the flight intent description completed to close all degrees of freedom, the method may return to step 530 where alternative strategies are selected for enriching the flight intent description. The method then continues as before through steps 540, 550 and 560.

Self-checking is performed such that the intent generation engine 104 will return an exception declaring the impossibility of generating a fully closed aircraft intent description 114 based on the initial flight intent description 101 in the defined operational context. The declaration of an exception may be triggered once all strategies have been tried, after a set number of iterations or after a pre-defined time delay.

Flight Intent Enrichment Summary

Figure 5:
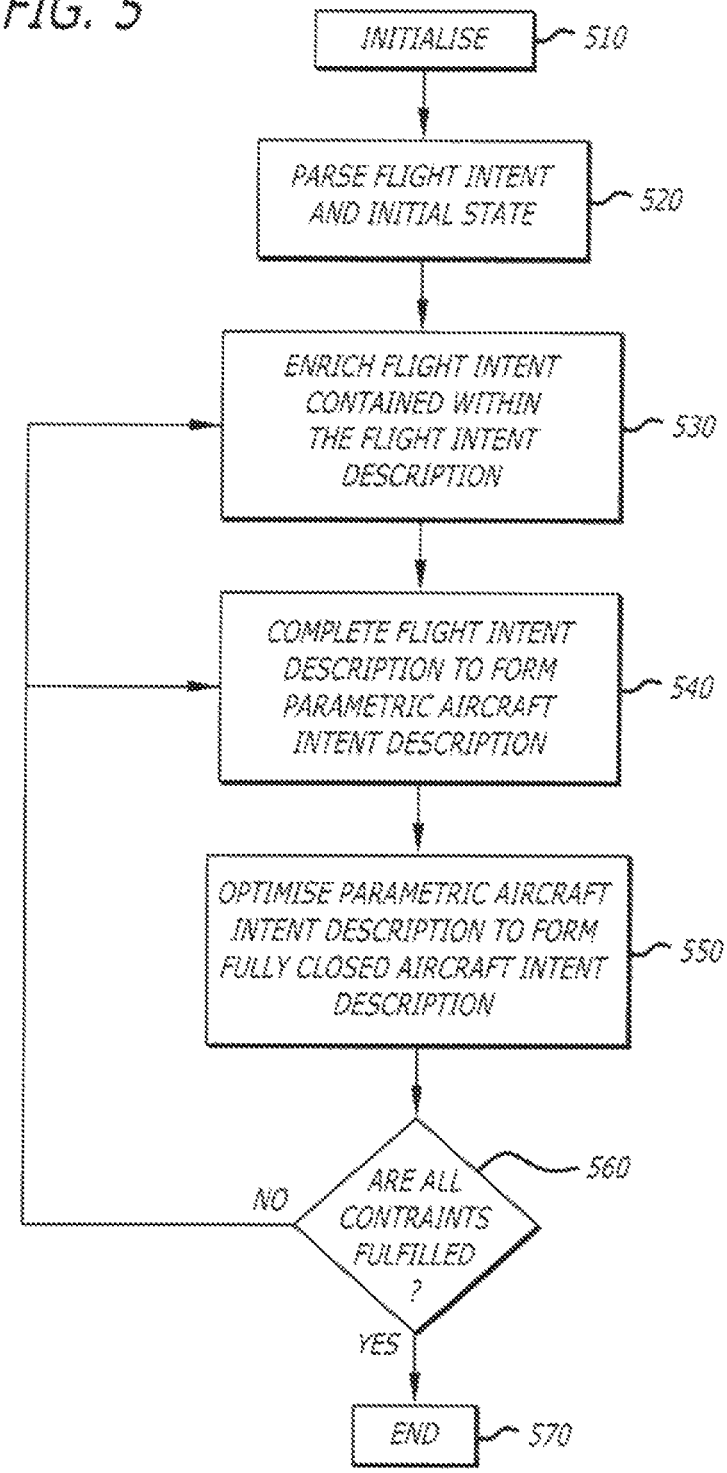
FIG. 5 shows a method of deriving an aircraft intent description.

At step 530 in FIG. 5, the intent generation engine 104 enriches the flight intent description with constraints and objectives retrieved from any of the user preferences model 105, the operational context model 106 and the aircraft performance model 118. To do this, the intent generation engine 104 identifies constraints and objectives from the models 105, 106 and 118 that are relevant to each flight segment included in the flight intent description (e.g. not all the constraints included in the operational context are likely to apply to a specific route or to all flight segments on a particular flight path).

Relevance of constraints and objectives to flight segments may be determined using descriptions associated with the data stored in the user preferences model 105, the operational context model 106 and the aircraft performance model 118. For example, data may be identified by the geographical region to which it applies and/or by the phase of flight to which it applies. For example, the operational context model 106 may contain a topographical description of several regions within an airspace. Each region may have a description of hazards to be avoided such as mountains and densely populated areas. A flight segment intent dataset that will apply within that region may be enriched with the associated constraints for that region. As a further example, the operational context model 106 may contain descriptions of STARs to be followed when arriving at an airport. The flight intent may indicate a preferred arrival waypoint into the terminal area, and so only the STAR description relating to that arrival point would be relevant, and so its constraints may be added to the instances of flight segment intent dataset of the corresponding flight segments.

Turning to the user preferences model 105, this may contain an airline's preferences relating to different phases of flight or to different aircraft types. For example, it might define that during take off and climb out, the aircraft is flown to minimise fuel consumption. Alternatively, the user preferences model 105 might define that during descent, the aircraft is maintained at the maximum altitude possible for as long as possible. It will be appreciated that flight segments relating to the descent phase of a flight may then have an associated objective to maintain maximum altitude.

The aircraft performance model 118 may contain preferences and limitations relevant to different flight portions. For example, maximum speeds for landing gear deployments will be relevant to only take off and landing phases.

The intent generation engine 104 enriches the flight intent description by expanding the flight segment intent datasets to add relevant constraints and objectives either to the associated instances of flight intent or as new instances of flight intent according to the syntactical and lexical rules imposed by the flight intent description language. The output of step 530 is an enriched flight intent description that has flight segment intent datasets comprising instances of open aircraft intent that may or may not be enriched with constraints and objectives.

Flight Intent Enrichment is Described in Further Detail Below.

Generating a Parametric Aircraft Intent Description

At step 540, the intent generation engine 104 closes any open degrees of freedom within flight segment intent datasets. Thus, the enriched flight intent description that may still contain open degrees of freedom is completed to ensure all degrees of freedom of motion and configuration are closed for all flight segment intent datasets. At this stage, parametric ranges may be used to close degrees of freedom, such that a parametric aircraft intent description is formed. This contains information on all degrees of freedom, but does not contain specific values for parameters such that the parametric aircraft intent description does not define a unique trajectory.

Figure 6:
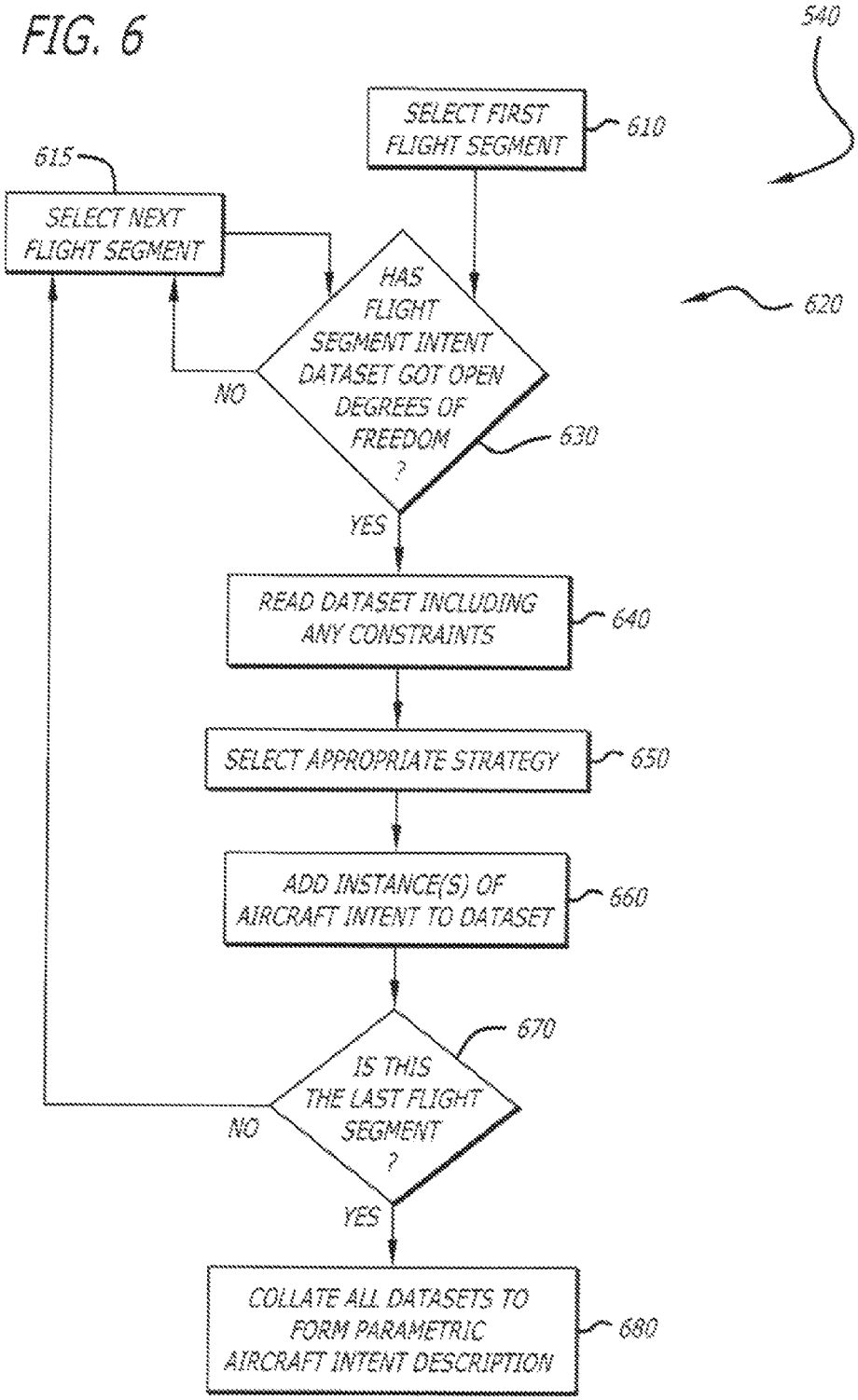
FIG. 6 shows how instances of open aircraft intent within a flight segment intent dataset may be completed to form a parametric aircraft intent description.

FIG. 6 shows how the enriched flight intent description may be completed to form the parametric aircraft intent description. The process starts at 610 where the first flight segment is selected. The flight segments may be ordered in any way, although ordering the flight segments chronologically is the obvious example. The ordering merely needs to provide a list of flight segments that may be processed sequentially.

After the first flight segment has been selected at 610, the process continues to a routine indicated at 620 in FIG. 6. The routine 620 is repeated for each flight segment in turn, as will be now be described.

At step 630, the flight segment intent dataset for the selected flight segment is checked to see whether the instances of open aircraft intent it contains leaves any degrees of freedom open. If all degrees of freedom are closed, the method continues to step 615 where the next flight segment is selected and the process enters routine 620 once more. If one or more open degrees of freedom are found at step 630, that flight segment continues through procedure 620 for further processing.

Next, at step 640, the flight segment intent dataset and any constraints pertaining to the current flight segment are retrieved. This data is used at step 650 to select an appropriate strategy for completing the open degrees of freedom. This may be done by looking at which degree or degrees of freedom must be closed. For example, the open degrees may relate to the vertical flight profile or may relate to landing gear configuration. The intent generation engine 104 has at its disposal strategies corresponding to templates for closing particular degrees of freedom. These strategies are tagged to identify to which degrees of freedom they relate. Composites may also be stored and associated with a strategy, ready for selection by the intent generation engine 104 and insertion into the flight segment intent dataset.

The following are examples of strategies and associated composites: geometric paths providing different lateral path composites to define different path shapes (e.g. right turn, left turn, sequence of turns), level flight, constant path angle ascend/descend, constant speed ascend/descend, general ascend/descend, CAS-MACH climb, MACH-CAS descend, level trust acceleration/deceleration, clean configuration (e.g. of landing gear, high lift devices and speed brakes), and scheduled configuration settings (e.g. landing gear deployed and high lift device extension for landing).

The strategies may also be tagged to indicate to which phase of flight they apply (e.g. take off, climb out, cruise, descent, final approach, landing, taxiing). The constraints are also used in determining which strategy should be selected. Returning to the example above, a constraint may specify a region of restricted airspace that is nearby, thus guiding the strategy chosen to ensure that the turn is made at an appropriate point to avoid the restricted airspace.

Heuristics may also be used when selecting a strategy. For example, a flight segment may not close the vertical profile. The intent generation engine 104 may revert back to flight segment intent datasets for earlier flight segments to find the last altitude specified and may then scan ahead to find the next flight segment that specifies an altitude. Comparison of the two altitudes may then guide selection of a suitable strategy. For example, if two flight segments specify the same altitude, intervening flight segments that do not specify an altitude may be amended using a strategy that maintains level flight.

Once a suitable strategy has been selected at step 650, the procedure 620 continues to step 660 where an aircraft intent primitive corresponding to the selected strategy is generated and added to the flight segment intent dataset. The primitive may be added as part of a composite where two or more primitives are to be combined, i.e. a strategy may require a primitive or a composite of primitives to describe the required instructions depending upon the complexity of the strategy.

Steps 650 and 660 are performed as necessary to ensure all open degrees of freedom are closed within the flight segment intent dataset. With this processing finished, at step 670 a check is made to see whether the flight segment being processed is the final flight segment. If not, the process loops back to step 615 where the next flight segment is selected and procedure 620 is entered once more.

When all flight segments have been processed, as determined at step 670, the process continues to step 680 where all the completed flight segment intent datasets are collated to form the parametric aircraft intent description, expressed using a formal language (the aircraft intent description language). This completes step 540 of FIG. 5. The parametric aircraft intent is then processed according to step 550 where the parametric ranges are resolved into specific parameter values through an optimisation process that will now be described with respect to FIG. 7.

Optimising the Parametric Aircraft Intent Description

The optimisation process of step 550 takes all the parameter ranges specified in the parametric aircraft intent description and calculates optimal values for each parameter by optimising an overall merit function that reflects the objectives defined in the instances of flight intent.

Figure 7:
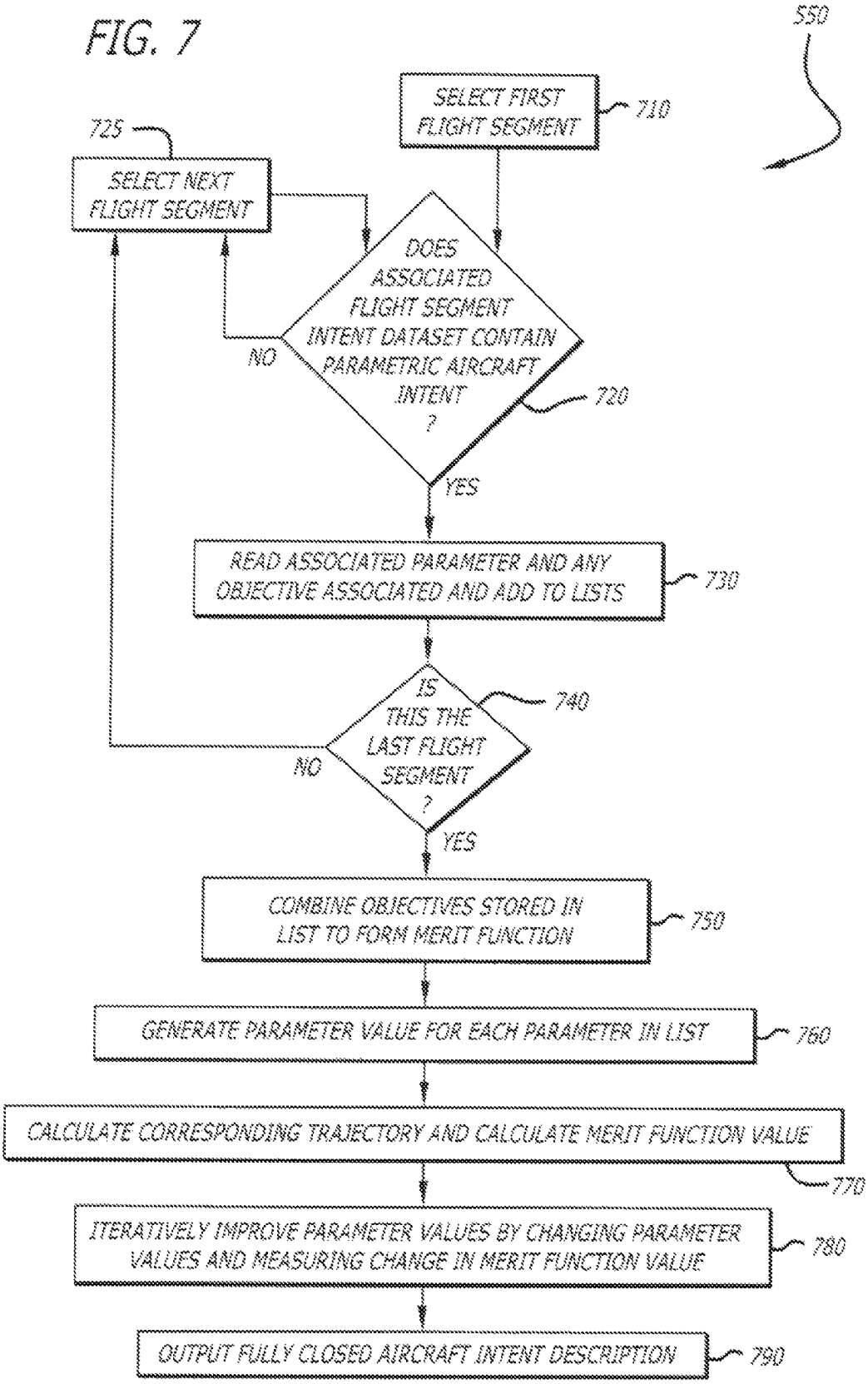
FIG. 7 shows how a parametric aircraft intent description may be optimised to provide a fully closed aircraft intent description.

As shown in FIG. 7, the process starts at step 710 where the first flight segment is selected. As described above, the flight segments may be ordered in any way that provides a list of flight segments for processing sequentially.

At step 720, the flight segment intent dataset is reviewed to determine whether it contains any instances of parametric aircraft intent such that the dataset contains parameter ranges than need resolving. If there is no parametric intent, the method proceeds to step 725 where the next flight segment is selected for processing. When a flight segment intent dataset is found at step 710 to define one or more parameter ranges, that parameter range and any associated objectives are retrieved and stored in respective lists, as shown at step 730. Then, at step 740, a check is made to see if the flight segment being processed currently is the final flight segment. If not, the process loops back to step 725 so that the next flight segment may be selected for processing at step 720 once more. In this way, the flight segment intent datasets of all flight segments are checked for parameter ranges, and lists are compiled that collate the parameter ranges to be resolved along with associated objectives.

At step 750, the objectives stored in the associated list are mathematically combined into a merit function that reflects all the objectives. The objectives may be stored in the user preferences model 105 as a mathematical function expressing the objective to be targeted. Then, forming the merit function may correspond to combining the individual mathematical functions describing each objective. The mathematical functions may be combined in any straight-forward manner. For example, a weighted combination may be formed, where weights are assigned to each objective according to its importance. Data may be stored in the user preferences model 105 to indicate the relative importance of the objectives.

If a parameter range is found that does not have an associated objective, a library of pre-defined mathematical functions may be used to provide a mathematical function for inclusion in the merit function. For example, a mathematical function may be associated with the parameter range that assigns a constant value irrespective of the parameter value chosen, such that the parameter value may be chosen as any within the parameter range, but optimised to lead to an overall improvement of the merit function value. For example, selection of a particular value for the parameter may contribute to achieving an objective relating to the preceding flight segment.

Consequently, the merit function rewards how well the objectives are met and penalises how badly the objectives are not met.

At step 760, each parameter range in the associated list is read, and the associated instance of aircraft intent that appears in the parametric aircraft intent description is amended such that the parameter range is replaced by a value falling within the range. Different schemes may be used to select a value, for example by selecting the maximum value, the minimum value, the mean value or by randomly generating a value. At the end of step 760, an aircraft intent description results that has all parameters defined and with no parameter ranges remaining. This model aircraft intent description is then tested by using the trajectory engine 112 to calculate the corresponding trajectory, from which the intent generation engine 104 can calculate the merit function value for the model aircraft intent description.

The process then proceeds to step 780 where the model aircraft intent description is optimised. This optimisation process improves the parameter values iteratively. That is, intent generation engine 104 goes through iterations of randomly changing some or all the parameter values, then calling the trajectory engine 112 to compute the new trajectory, and computing the new merit function value and determining whether it has been improved. In this way, the parameter values are evolved in a way that optimises the merit function. This may be done using any well known technique, such as using evolutionary algorithms like genetic algorithms or through linear optimisation. These techniques provide an optimised fully closed aircraft intent description, and this is provided as an output at step 790.

Flight Intent Enrichment and Generating Aircraft Intent

A method of generating aircraft intent that makes use of a particular way of enriching flight intent will now be described with reference to FIGS. 8 to 10.

Figure 8:
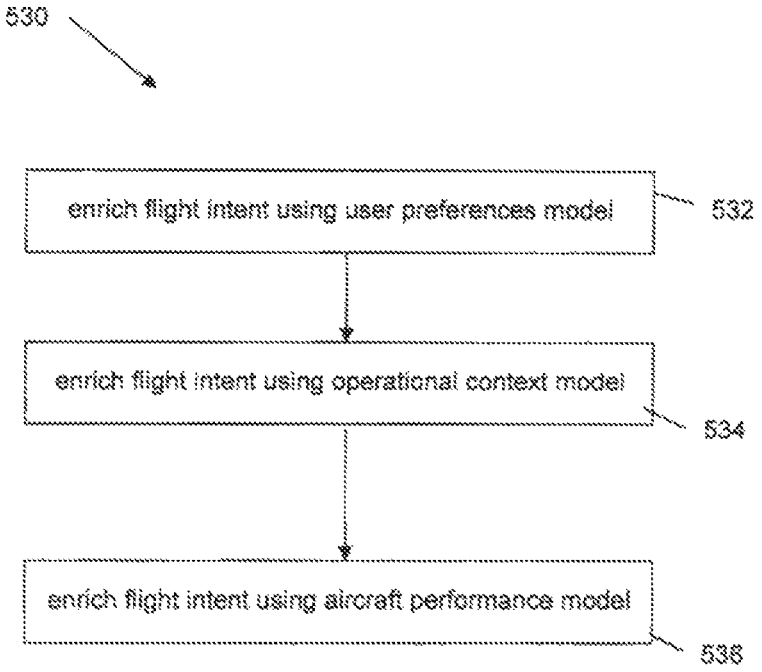
FIG. 8 shows how a flight intent description may be enriched.

FIG. 8 shows that the flight intent enrichment step 530 of FIG. 5 is broken down into three sequential stages. First, as shown at 532, the flight intent description is enriched using the user preferences model 105. Then, as shown at 534, the flight intent description is enriched using the operational context model 106. Finally, as shown at 536, the flight intent description is enriched using the aircraft performance model 118.

Figure 9:
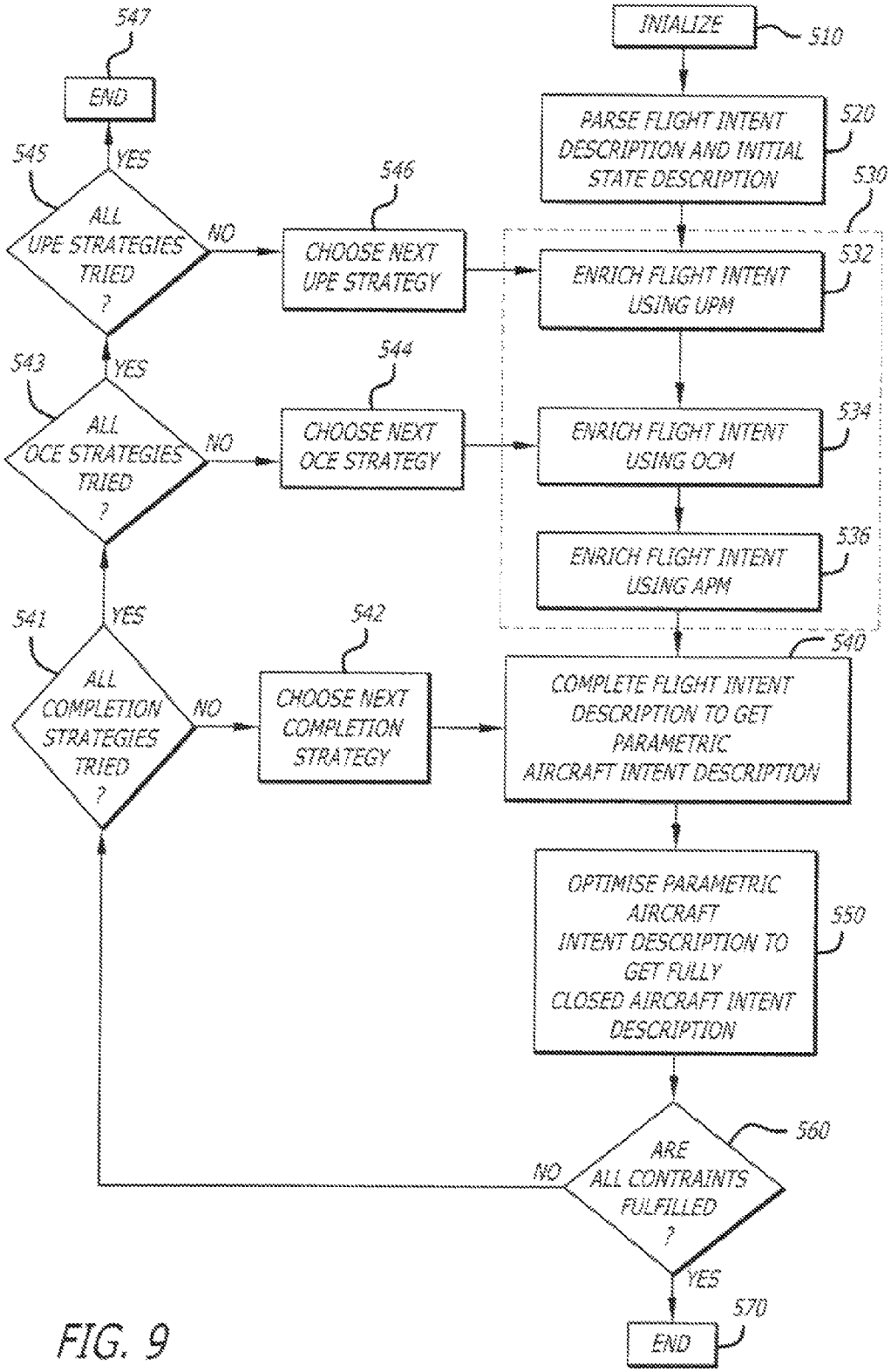
FIG. 9 shows a method of deriving an aircraft intent description.

FIG. 9 is an adaptation of FIG. 5 that shows how the three-stage enrichment may be used in an overall method of generating the fully closed aircraft intent description 123. FIG. 10 is an adaptation of FIG. 2 to show how the overall system can be used to perform the method of FIG. 9.

Figure 10:
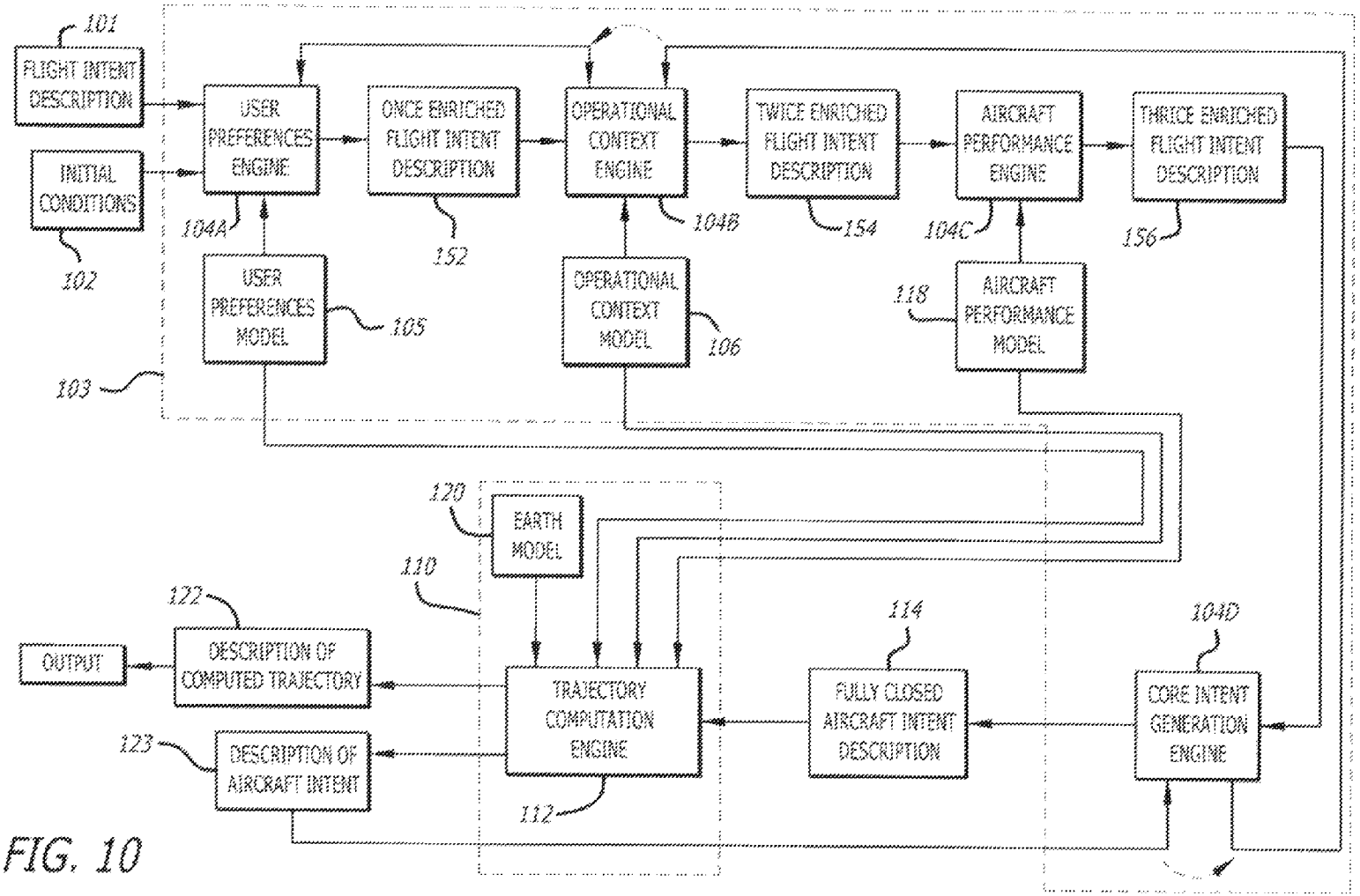
FIG. 10 is a schematic representation of a system for generating an aircraft intent description.

FIG. 10 shows that the intent generation engine 104 split into four components 104A-D. These components may correspond to separate computer processors programmed with software modules providing the desired functionality. Alternatively, a single computer processor may provide two or more, and even all, the four engines 104A-D. For example, the four engines 104A-D may correspond to four software modules operating on a single computer processor or network of computer processors.

A user preferences engine 104A is the first engine to enrich the flight intent. The user preferences engine 104A uses the user preferences model 105 to enrich the flight intent and to produce as an output a once enriched flight intent description 152. This enrichment using the user preferences model 105 is performed as previously described.

The once enriched flight intent description 152 is passed to an operational context engine 104B that uses the operational context model 106 to enrich further the flight intent description 152, thereby producing twice enriched flight intent description 154. The enrichment of the flight intent description 152 using the operational context model 106 is performed as previously described.

The twice enriched flight intent description 154 is passed to an aircraft performance engine 104C that uses the aircraft performance model 118 to enrich still further the flight intent description 154, thereby producing thrice enriched flight intent description 156. The enrichment of the flight intent description 154 using the aircraft performance model 118 is performed as previously described. In this embodiment, the aircraft performance model 118 is part of the intent generation infrastructure 103 (as compared to FIG. 2 where the aircraft performance model 118 is part of the trajectory computation infrastructure 110). As can be seen from FIG. 10, the user preferences model 105, the operational context model 106 and the aircraft performance model 118 may all pass data to the trajectory computation engine 112 of the trajectory computation infrastructure 110.

The core intent generation engine 104D receives the thrice enriched flight intent description 156 and completes the instances of open aircraft intent within the flight segment intent datasets by adding instances of aircraft intent to close all degrees of freedom and so generates the parametric aircraft intent description, as described previously with respect to step 540 of FIG. 5. The core intent generation engine 104D also optimises the parametric aircraft intent to produce the fully closed aircraft intent description 114, as described previously with respect to step 550 of FIG. 5.

The fully closed aircraft intent description 114 is passed to the trajectory computation engine 112 to allow the corresponding trajectory to be calculated. The trajectory computation engine 112 also uses the Earth model 120 when calculating the trajectory, and may also call data from any of the user preferences model 105, the operational context model 106 and the aircraft performance model 118. The trajectory computation engine 112 provides as outputs a description of the computed trajectory 122 and a description of the fully closed aircraft intent description 123, as has already been described with respect to FIG. 2.

FIG. 10 also indicates that the fully closed aircraft intent description 123 may be passed back to the core intent generation engine 104D, the operational context engine 104B and the use preferences engine 104A, as will now be described with reference to FIG. 9.

FIG. 9 shows a method of generating an aircraft intent description 123 according to an embodiment of the present invention. Many steps are as already described for FIG. 5, and so have been given corresponding reference numerals and are only summarised here.

At step 510, the intent generation infrastructure 103 is initialised. At step 520, the flight intent description 101 and initial conditions description 102 are received by the intent generation infrastructure 103, and are parsed to create the flight segment intent datasets. Each dataset contains one or more instances of open aircraft intent, with each instance of open aircraft intent providing information relating to some aspect of the flight during that flight segment that will affect one of more degrees of freedom of motion and/or configuration. This parsing may be done by the user preferences engine 104A. However, in this embodiment, a separate engine (not shown) is provided as part of the intent generation infrastructure 103 for this purpose.

At step 530, the intent generation engines 104A-D enrich the parsed flight intent using the user preferences model 105, the operational context model 106 and the aircraft performance model 118. Constraints and objectives from the models 105, 106 and 118 are identified that are relevant to the flight segment intent datasets (e.g. not all the constraints included in the operational context are likely to apply to a specific route or to all flight segments on a particular flight path). The intent generation engines 104A-D enrich the flight intent by expanding the datasets to add the relevant constraints and objectives to instances of flight intent according to the syntactical and lexical rules imposed by the flight intent description language.

First, at step 532, the parsed flight intent is provided to the user preferences engine 104A so that it may be converted into the once enriched flight intent description 152. The user preferences engine 104A has at its disposal a set of strategies and heuristics to allow it to convert the flight intent description into the once enriched flight intent description 152 by adding objectives and constraints to the flight segment intent datasets that are relevant to the flight segments.

Second, at step 534, the once enriched flight intent description 152 is provided to the operational context engine 104B. The operational context engine 104B has at its disposal a set of strategies and heuristics to allow it to convert the once enriched flight intent description 152 into twice enriched flight intent description 154. The operational context engine 104B adds objectives and constraints that are relevant to the flight segments including flight segments already containing constraints and objectives added by the user preferences engine 104A. Thus, the operational context engine 104B seeks to enrich further flight segments already enriched by the user preferences engine 104A. For example, the user preferences engine 104A may add an objective relating to a preferred route (say to follow a route that provides a southerly approach to a particular airport), and the operational context engine 104B may add a relevant constraint (say to define a STAR to be followed for aircraft approaching an airport from the south).

Third, at step 536, the twice enriched flight intent description 154 is provided to the aircraft performance engine 104C. The aircraft performance engine 104C has at its disposal a set of strategies and heuristics to allow it to convert the twice enriched flight intent description 154 into the thrice enriched flight intent description 156. The aircraft performance engine 104C adds objectives and constraints that are relevant to the flight segments including flight segments already containing constraints and objectives added by the user preferences engine 104A and/or the operational context engine 104B. Returning to the example above, the aircraft performance engine 104C may add constraints for the STAR corresponding to flap deployment speeds and landing gear deployment speed.

The thrice enriched flight intent description 156 is then passed to the core intent generation engine 104D where, at step 540, the engine 104D identifies flight segment intent datasets of the thrice enriched flight intent description having open degrees of freedom. The core intent generation engine 104D fills these datasets with instances of aircraft intent to close all degrees of freedom. This process is driven by several completion strategies, as previously explained with reference to FIGS. 5 and 6. Then, at step 550, the core intent generation engine 104D optimises the parametric aircraft intent description. This optimisation process 550 takes all the parameter ranges specified in the parametric aircraft intent description, and calculates optimal values for each parameter by optimising an overall merit function as previously described for FIGS. 5 and 7.

The method proceeds to step 560 where the core intent generation engine 104D uses the trajectory engine 112 to generate the corresponding trajectory and to check that the predicted trajectory for each model aircraft intent description fulfils all constraints defined by the operational context model 106, user preferences model 105, the aircraft performance model 118 and the original flight intent description 101.

If all constraints are fulfilled, the method ends at step 570 where a description of the completed, fully closed aircraft intent 123 is provided and/or a description of the corresponding trajectory 122 is provided. If any constraints are found not to be fulfilled, the method will repeat certain steps to try to find a fully closed aircraft intent description that does satisfy all constraints.

In contemplated embodiments, the first method tried is to repeat optimisation step 550 using alternative optimisation strategies. However, in this embodiment, the first method tried is to repeat completion step 540 using alternative strategies (this would be the second method tried if alternative optimisation strategies were tried as the first method). That is, the method continues to step 541 where the core intent generation engine 104D determines whether all completion strategies have been tried. If not, the method continues to step 542 where a new completion strategy is selected and then method steps 540 to 560 are repeated. That is, the thrice enriched flight intent description 156 is retrieved and completed using the new strategy, the resulting parametric aircraft intent description is optimised at step 550 and then the check that all constraints are satisfied is repeated at step 560.

The method returns to step 540 where the original enriched flight intent description provided at step 530 is retrieved and the intent generation engine 104 uses an alternative strategy to complete the flight intent description by inserting instances of aircraft intent to close all degrees of freedom. The method then continues as before through steps 550 and 560.

If at step 541 it is found that all completion strategies have been tried, then the method continues to step 543. At step 543, the operational context engine 104B determines whether all strategies available to the operational context engine 104B have been tried. If not, the method continues to step 544 where the operational context engine 104B selects an untried strategy. Then steps 534, 536, 540, 550 and 560 are repeated. Also, the loop through steps 541 and 542 are repeated such that different completion strategies are used in attempts to provide an aircraft intent 114 that satisfies all constraints. In this way, the method cycles through different strategies at the operational context engine 104B, with the different completion strategies being tried for each of the operational context engine's strategies. Should this fail, then a negative answer will arise at step 543. That is, at step 543, the operational context engine 104B will determine that all its strategies have been tried.

In this case, the method continues to step 545 where the user preferences engine 104A tries different strategies. First, at step 545, a check is made to ensure that all the strategies available to the user preferences engine 104A have not been tried. If they have, the method ends at step 547 where it is reported that no aircraft intent could be found that satisfies all constraints. If the user preferences engine 104A determines that not all of its strategies have been tried, it proceeds to step 546 where an untried strategy is selected.

Then steps 532, 534, 536, 540, 550 and 560 are repeated. Also, the loop through steps 541 and 542 and the loop through steps 543 and 544 are repeated such that different operational context engine strategies and different completion strategies are used in attempts to provide an aircraft intent 114 that satisfies all constraints. In this way, the method cycles through different strategies at the core intent generation engine 104D, the operational context engine 104B and the user preferences engine 104A to find an aircraft intent 114 that meets all constraints.

The order in which alternative strategies are attempted prioritises the constraints and objectives stored in the user preferences model 105. That is, changes made when using the user preferences engine 104A are made last after all other combinations of operational context engine strategies and completion strategies have been tried. Then, the constraints and objectives stored in the operational context model 106 are next prioritised. That is, all the available completion strategies are tried before any changes to the operational context engine strategies are made.

Example of Approach to Airport

An example of the above methods will now be described with reference to FIGS. 11 to 14. In this example, an aircraft 810 is approaching an airport to land on a runway 820. The flight intent may merely specify that the aircraft is to land on runway 820 after arrival at waypoint ALPHA.

In order to provide a fully closed aircraft intent description 114, the intent generation engine 104 may augment this basic flight intent with information retrieved from the operational context model 106 describing a STAR procedure to be followed when approaching the airport. For example, intent generation engine 104 may establish the wind direction, determine the direction for a headwind approach to the runway 820, and retrieve the STAR procedure for such a landing for aircraft arriving at waypoint ALPHA.

Figure 11:
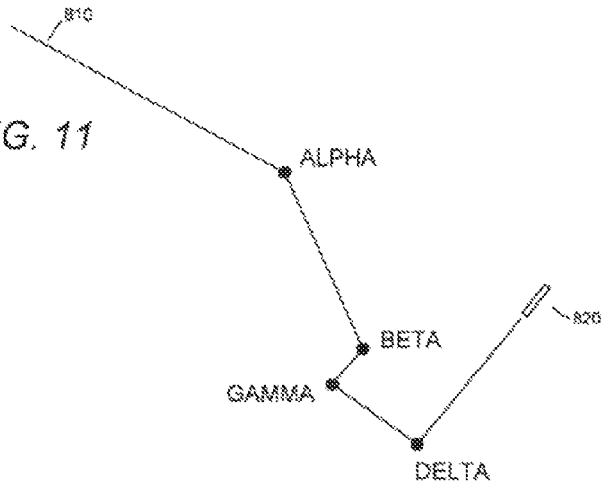
FIG. 11 shows a lateral flight profile to be followed when approaching an airport.
Figure 12:
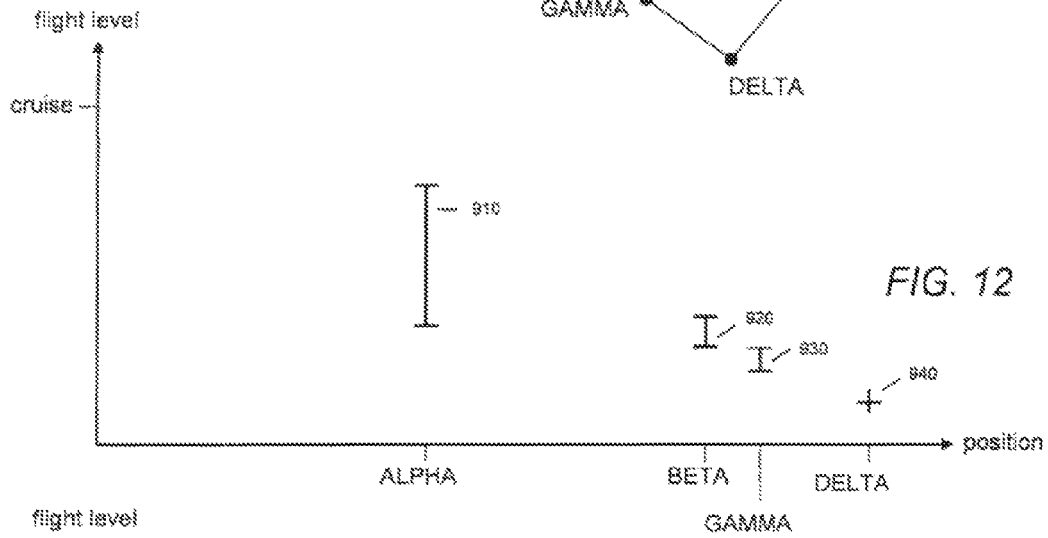
FIG. 12 shows vertical flight profile restrictions that apply to the approach shown in FIG. 11.

The STAR procedure will correspond to a set of restrictions. In this example, the lateral path to be followed routes the aircraft through waypoints ALPHA, BETA, GAMMA and DELTA, ready for a final straight approach to runway 820. These waypoints are shown in FIG. 11. The STAR procedure may also contain restrictions on speeds along the route as well as altitudes to be maintained at each waypoint. These altitudes are shown in FIG. 12.

At waypoint ALPHA, a broad permissible altitude range is defined, as indicated at 910. Smaller altitude ranges are defined for waypoints BETA and GAMMA, as shown at 920 and 930 respectively. A specific altitude is defined for waypoint DELTA as shown at 940, corresponding to a starting altitude for final approach from which a glide slope may be intercepted.

The intent generation engine 104 may use these restrictions to augment the flight intent. For example, additional flight segments may be created corresponding to the segments between the waypoints to be followed. Moreover, parametric aircraft intent may be created where the altitude ranges at each waypoint are defined without a specific altitude being provided. Objectives may be used to specify altitudes to be met, as follows.

Figure 13:
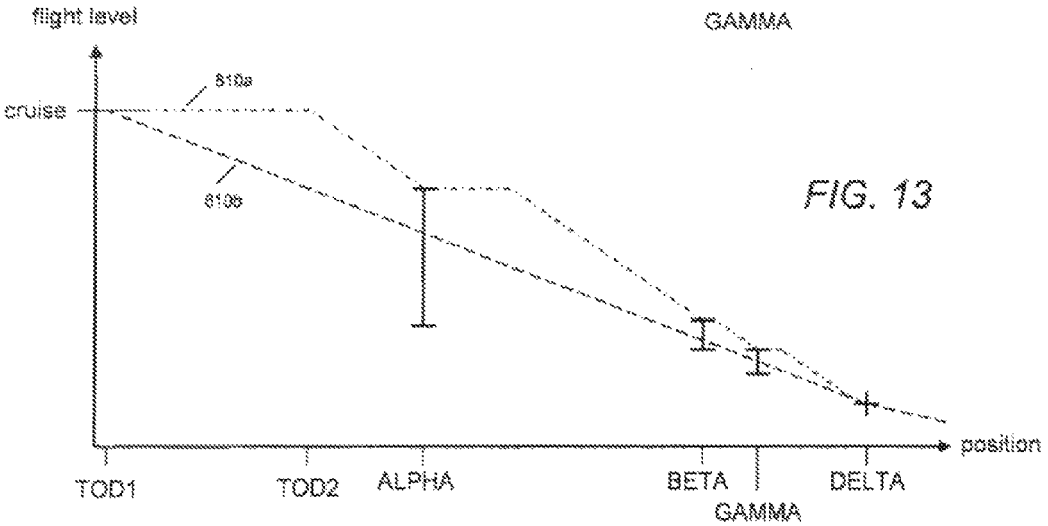
FIG. 13 shows two vertical flight profiles that meet the restrictions shown in FIG. 12.

FIG. 13 shows two alternative vertical profiles, 810*a* and 810*b*. Profile 810*a* corresponds to aircraft 810 being operated by an airline that prefers to fly as high as possible for as long as possible. This objective will be recorded in the user preferences model 105. Accordingly, the intent generation engine 104 sets altitudes at each waypoint as the maximum specified, then calculates the maximum rate of descent possible for the aircraft 810 to establish when each descent phase must begin, and creates segments that define level flight between each descent phase, along with defining the top of descent point (TOD2). Thus, by using the objective, intent generation engine 104 generates aircraft intent that will produce the stepped-down vertical profile shown at 810*a*. This profile sees the aircraft 810 fly as high as possible for as long as possible before making a steep descent just in time to meet the maximum altitude prescribed for each waypoint.

Another airline may not like such an approach that sees the aircraft accelerate between level flight and descents a number of times. This second airline may prefer to fly a steady continuous descent with minimal changes in flight path angle. This approach may be reflected as an objective stored in the user preferences model 105. Intent generation engine 104 may retrieve this objective, and determine the vertical profile shown as 810*b* in FIG. 13. This vertical profile sees a steady descent with constant flight path angle from a calculated top of descent point TOD1 that passes through all the required altitude ranges.

As can be seen from FIG. 13, some variation in flight path angle may be made while still ensuring the altitude restrictions are met. Further objectives may guide the final selection of vertical profile. For example, the airline may have a further objective of flying continuous descent approaches with the throttles set to idle and with minimal deployment of speed brakes. This objective may then be used by the intent generation engine 104 to set an appropriate flight path angle.

Objectives to fly a constant flight path angle during descent and to fly continuous descent approaches at idle complement each other in that they both affect the vertical profile. At times, these objectives will cause a conflict in that both cannot be met. To avoid this, objectives may be prioritised such that the intent generation engine 104 can determine which objective is to be met where conflicts arise.

The airline may store restrictions in the user preferences model 105 as well as objectives. For example, as explained above, the lateral profile is defined in part by the waypoints specified in the STAR description in the operational context model 106. However, these restrictions leave open how the aircraft 810 makes the turns to meet the lateral position of each of waypoints ALPHA, BETA, GAMMA and DELTA. The airline may also set restrictions, for example not to exceed a certain bank angle for the benefit of passenger comfort. The intent generation engine 104 may retrieve this objective from the user preferences model 105 during the flight intent enrichment step 530. At step 550, this restriction may be used to set a parameter range for the bank angle which is then optimised at step 560.

Contemplated Applications

The present invention may find utility on any application that requires prediction of an aircraft's trajectory. For example, the trajectory computation infrastructure 110 may be provided as part of a flight management system of an aircraft. The flight management system may make use of the trajectory prediction facility when determining how the aircraft is to be flown.

A trajectory predicted as described in the preceding paragraph may be provided to air traffic management, akin to the provision of a detailed flight plan.

For an air-based trajectory computation infrastructure, the flight management system may have access to some of the information required to generate the aircraft intent. For example, airline preferences may be stored locally for retrieval and use. Moreover, the aircraft performance model 118 and Earth model 120 may be stored locally and updated as necessary. Further information may be input by the pilot, for example the particular SID, navigation route and STAR to be followed, as well as other preferences like when to deploy landing gear, change flap settings, engine ratings, etc. Some missing information may be assumed, e.g. flap and landing gear deployment times based on recommended airspeed.

All this required information may be acquired before a flight, such that the trajectory of the whole flight may be predicted. Alternatively, only some of the information may be acquired before the flight and the rest of the information may be acquired en route. This information may be acquired (or updated, if necessary) following a pilot input, for example in response to a change in engine rating or flight level. The trajectory computation infrastructure 110 may also update the predicted trajectory, and hence the aircraft intent as expressed in the aircraft intent description language, due to changes in the prevailing atmospheric conditions, as updated through the Earth model 120. Updates may be communicated via any of the types of well-known communication link 230 between the aircraft and the ground: the latest atmospheric conditions may be sent to the aircraft and the revised aircraft intent or predicted trajectory may be sent from the aircraft.

Air traffic management applications will be similar to the above described air-based system. Air traffic management may have information necessary to determine aircraft intent, such as flight procedures (SIDs, STARs, etc), information relating to aircraft performance (as an aircraft performance model), atmospheric conditions (as an Earth model), and possibly even airline preferences. Some information, such as pilot preferences relating to for example when to change the aircraft configuration, may be collected in advance of a flight or during a flight. Where information is not available, air traffic management may make assumptions in order for the aircraft intent to be generated and the trajectory to be predicted. For example, an assumption may be made that all pilots will deploy their landing gear ten nautical miles from a runway threshold or at a particular airspeed.

Air traffic management may use the predicted trajectories of aircraft to identify potential conflicts. Any potential conflicts may be resolved by advising one or more of the aircraft of necessary changes to their flight/aircraft intent.

The person skilled in the art will appreciate that variations may be made to the above described embodiments without departing from the scope of the invention defined by the appended claims.

We claim:

1. A computer-implemented method of generating an aircraft intent description expressed in a formal language that provides an unambiguous four dimensional description of an aircraft's intended motion and configuration during a period of flight, comprising:

obtaining, by an intent generation infrastructure, a flight intent description corresponding to a flight plan spanning the period of the flight;

ensuring, by the intent generation infrastructure, that the flight intent description is parsed to provide instances of flight intent, wherein each of the instances of the flight intent is spanning a flight segment, and wherein flight segments together span the period of the flight, wherein the flight segments represent an intent of changing an aircraft motion state from one state into another;

for each flight segment, generating, by the intent generation infrastructure, an associated flight segment intent dataset that comprises at least one of at least one instance of the flight intent and at least one instance of open aircraft intent, wherein each of the at least one instance of the open aircraft intent describes the aircraft's motion in at least one degree of freedom of motion;

enriching, by the intent generation infrastructure, the flight intent description to generate an enriched flight intent description by using user preferences;

enriching, by the intent generation infrastructure, the enriched flight intent description to generate a further enriched flight intent description by using operational context;

enriching, by the intent generation infrastructure, the further enriched flight intent description to generate a still further enriched flight intent description by using aircraft performance;

closing, by the intent generation infrastructure, the instances of the open aircraft intent to form a parametric aircraft intent description; and optimizing, by the intent generation infrastructure, the parametric aircraft intent description to generate a fully closed aircraft intent description expressed in the formal language to assist in flying the aircraft with the unambiguous four dimensional description of the aircraft's intended motion and configuration during the period of flight.

2. The method of claim 1, wherein the enriching the flight intent description to generate an enriched flight intent description by using user preferences comprises:

comparing the flight segment intent datasets with at least one of at least one constraint and at least one objective stored in a user preferences database, identifying at least one of the at least one constraint and the at least one objective that are relevant to the flight segment intent datasets, and enriching, according to a user preferences enrichment strategy, the flight segment intent datasets with information describing at least one of the at least one constraint and the at least one objective, thereby providing the enriched flight intent description.

3. The method of claim 2, wherein the user preferences database has stored therein objectives that comprise information describing operational preferences.

4. The method of claim 2, wherein the identifying the at least one objective that is relevant to the flight segment intent datasets comprises identifying objectives associated with the aircraft.

5. The method of claim 1, wherein the enriching the enriched flight intent description to generate a further enriched flight intent description by using operational context comprises:

comparing the flight segment intent datasets with at least one of a least one constraint and at least one objective stored in an operational context database, identifying at least one of the at least one constraint and the at least one objective that are relevant to the flight segment intent datasets, and enriching, according to an operational context enrichment strategy, the flight segment intent datasets with information describing at least one of the at least one constraint and the at least one objective, thereby providing the further enriched flight intent description.

6. The method of claim 5, wherein the operational context database has stored therein constraints that comprise restrictions on flying within an airspace.

7. The method of claim 5, wherein the identifying the at least one constraint that is relevant to the flight segment intent datasets comprises identifying only those constraints affecting airspace through which the aircraft will pass during the corresponding flight segment.

8. The method of claim 1, wherein the enriching the further enriched flight intent description to generate a still further enriched flight intent description by using aircraft performance comprises:

comparing the flight segment intent datasets with at least one of at least one constraint and at least one objective stored in an aircraft performance database, identifying at least one of the at least one constraint and the at least one objective that are relevant to the flight segment intent datasets, and enriching the flight segment intent datasets with information describing at least one of the at least one constraint and the at least one objective, thereby providing the still further enriched flight intent description.

9. The method of claim 1, wherein the closing the instances of the open aircraft intent to form a parametric aircraft intent description comprises:

converting the instances of the open aircraft intent within the flight segment intent datasets into instances of parametric aircraft intent by identifying the flight segment intent datasets where not all degrees of freedom are closed, completing the flight segment intent datasets where not all degrees of freedom are closed by at least one of adding and amending at least one of the instances of aircraft intent to close all degrees of freedom by selecting a completion strategy from a plurality of stored completion strategies and at least one of adding and amending at least one of the instances of the aircraft intent corresponding to the completion strategy that is selected, and collating the flight segment intent datasets, thereby providing a fully closed parametric aircraft intent description for the period of the flight expressed in the formal language, and wherein the adding at least one of the instances of the aircraft intent includes providing a parameter range, thereby forming the parametric aircraft intent description.

10. The method of claim 1, wherein the optimizing the parametric aircraft intent description to generate a fully closed aircraft intent description comprises:

determining an optimal value for each parameter of each parameter range in the parametric aircraft intent description according to an optimization strategy, thereby generating the fully closed aircraft intent description.

11. The method of claim 1, wherein when the fully closed aircraft intent description cannot be generated to fulfill all objectives and constraints contained in the still further enriched flight intent description, the method further comprises:

performing optimization loops comprising repeating iterations of optimizing the parametric aircraft intent description according to alternative optimization strategies until the fully closed aircraft intent description is generated that fulfills all of the objectives and the constraints contained in the still further enriched flight intent description.

12. The method of claim 11, wherein when, after performing the optimization loops, the fully closed aircraft intent description cannot be generated to fulfill all of the objectives and the constraints contained in the still further enriched flight intent description, the method further comprises:

performing completion loops comprising repeating iterations of completing the instances of the open aircraft intent according to alternative completion strategies, and during each iteration of each of the completion loops, performing the optimization loops until the fully closed aircraft intent is generated that fulfills all of the objectives and the constraints contained in the still further enriched flight intent description.

13. The method of claim 12, wherein when, after performing the completion loops, the fully closed aircraft intent description cannot be generated to fulfill all of the objectives and the constraints contained in the still further enriched flight intent description, the method further comprises:

performing operational context loops comprising repeating iterations of enriching the enriched flight intent description to generate the further enriched flight intent description by using the operational context according to alternative operational context enrichment strategies followed by enriching the further enriched flight intent description to generate the still further enriched flight intent description by using the aircraft performance, and during each iteration of each of the operational context loops, performing the completion loops until the fully closed aircraft intent description is generated that fulfills all of the objectives and the constraints contained in the still further enriched flight intent description.

14. The method of claim 13, wherein when, after performing the operational context loops, the fully closed aircraft intent description cannot be generated to fulfill all of the objectives and the constraints contained in the still further enriched flight intent description, the method further comprises:

performing user preferences loops comprising repeating iterations of enriching the flight intent description to generate the enriched flight intent description by using the user preferences according to alternative user preferences enrichment strategies, and during each iteration of each of the user preferences loops, performing the operational context loops until the fully closed aircraft intent description is generated that fulfills all of the objectives and the constraints contained in the still further enriched flight intent description.

15. The method of claim 1, wherein when the fully closed aircraft intent description cannot be generated to fulfill all objectives and constraints contained in the still further enriched flight intent description, the method further comprises:

performing completion loops comprising repeating iterations of completing the instances of the open aircraft intent according to alternative completion strategies, and during each iteration of each of the completion loops, performing optimizing loops until the fully closed aircraft intent is generated that fulfills all of the objectives and the constraints contained in the still further enriched flight intent description.

16. The method of claim 15, wherein when, after performing the completion loops, the fully closed aircraft intent description cannot be generated to fulfill all of the objectives and the constraints contained in the still further enriched flight intent description, the method further comprises:

performing operational context loops comprising repeating iterations of enriching the enriched flight intent description to generate the further enriched flight intent description by using the operational context according to alternative operational context enrichment strategies followed by enriching the further enriched flight intent description to generate the still further enriched flight intent description by using the aircraft performance, and during each iteration of each of the operational context loops, performing the completion loops until the fully closed aircraft intent description is generated that fulfills all of the objectives and the constraints contained in the still further enriched flight intent description.

17. The method of claim 16, wherein when, after performing the operational context loops, the fully closed aircraft intent description cannot be generated to fulfill all of the objectives and the constraints contained in the still further enriched flight intent description, the method further comprises:

performing user preferences loops comprising iteratively repeating iterations of enriching the flight intent description to generate the enriched flight intent description by using the user preferences according to alternative user preferences enrichment strategies, and during each iteration of each of the user preferences loops, performing the operational context loops until the fully closed aircraft intent description is generated that fulfills all of the objectives and the constraints contained in the still further enriched flight intent description.

18. The method of claim 1, wherein the closing the instances of the open aircraft intent comprises:

identifying completion strategies by at least one degree of freedom that the completion strategies influence, and selecting one of the completion strategies to close the at least one degree of freedom in an identified flight segment from the completion strategies identified to influence the at least one degree of freedom.

19. The method of claim 1, wherein the closing the instances of the open aircraft intent comprises:

identifying completion strategies by a phase of flight to which the completion strategies apply, and selecting one of the completion strategies to close a degree of freedom from the completion strategies identified to influence the degree of freedom and identified to apply to the phase of the flight associated with an identified flight segment.

20. The method of claim 1, wherein the optimizing the parametric aircraft intent description comprises determining optimal values by:

generating initial parameter values according to a optimization strategy, thereby forming a model aircraft intent description;

calculating a trajectory from the model aircraft intent description;

calculating a merit function value for the trajectory using a merit function; and repeating iterations of amending the parameter values, calculating the resulting trajectory and calculating the resulting merit function value to determine whether the fully closed aircraft intent description is improved, thereby optimizing the parameter values by improving the merit function value.

21. The method of claim 1, wherein the method further comprises calculating a trajectory for a period of the flight from the fully closed aircraft intent description.

22. The method of claim 21, wherein the method further comprises one of causing the aircraft to fly at the trajectory and comparing the trajectory with trajectories of other aircraft to identify conflicts.

23. A system for generating an aircraft intent description expressed in a formal language that provides an unambiguous four dimensional description of an aircraft's intended motion and configuration during a period of flight, comprising:

a user preferences database;

an operational context database;

an aircraft performance database; and an intent generation infrastructure configured:

to obtain a flight intent description corresponding to a flight plan spanning the period of the flight, to ensure that the flight intent description is parsed to provide instances of flight intent, wherein each of the instances of the flight intent is spanning a flight segment, and wherein flight segments together span the period of the flight, wherein the flight segments represent an intent of changing an aircraft motion state from one state into another, to generate, for each flight segment, an associated flight segment intent dataset that comprises at least one of at least one instance of the flight intent and at least one instance of open aircraft intent, wherein each of the at least one instance of the open aircraft intent describes the aircraft's motion in at least one degree of freedom of motion, to enrich the flight intent description to generate an enriched flight intent description by using user preferences by using the user preferences database, to enrich the enriched flight intent description to generate a further enriched flight intent description by using operational context by using the operational context database, to enrich the further enriched flight intent description to generate a still further enriched flight intent description by using aircraft performance by using the aircraft performance database, to close the instances of the open aircraft intent to form a parametric aircraft intent description, and to optimize the parametric aircraft intent description to generate a fully closed aircraft intent description expressed in the formal language to assist in flying the aircraft with the unambiguous four dimensional description of the aircraft's intended motion and configuration during the period of flight.

* * * * *